US008950970B2

(12) United States Patent
Gingrich, Sr.

(10) Patent No.: US 8,950,970 B2
(45) Date of Patent: Feb. 10, 2015

(54) DOUBLE CROSSOVER MERGING INTERCHANGE

(76) Inventor: Michael A. Gingrich, Sr., Sycamore, IL (US)

( * ) Notice: Subject to any disclaimer, the term of this patent is extended or adjusted under 35 U.S.C. 154(b) by 82 days.

(21) Appl. No.: 13/542,847

(22) Filed: Jul. 6, 2012

(65) Prior Publication Data

US 2013/0011190 A1 Jan. 10, 2013

Related U.S. Application Data

(60) Provisional application No. 61/506,032, filed on Jul. 9, 2011.

(51) Int. Cl.
*E01C 1/00* (2006.01)
*E01C 1/04* (2006.01)

(52) U.S. Cl.
CPC ..... *E01C 1/04* (2013.01)
USPC ..... 404/1

(58) Field of Classification Search
USPC ..... 404/1
See application file for complete search history.

(56) References Cited

U.S. PATENT DOCUMENTS

| | | | | |
|---|---|---|---|---|
| 2,949,067 | A * | 8/1960 | Cedeno | 404/1 |
| 3,394,638 | A * | 7/1968 | Burrell | 404/1 |
| 4,630,961 | A * | 12/1986 | Hellwig | 404/1 |
| 5,049,000 | A * | 9/1991 | Mier et al. | 404/1 |
| 5,795,095 | A * | 8/1998 | Heller | 404/1 |
| 6,685,386 | B1 * | 2/2004 | Lee | 404/1 |
| 7,425,104 | B2 * | 9/2008 | Buteliauskas | 404/1 |
| 7,473,050 | B2 * | 1/2009 | Liu et al. | 404/1 |
| 2008/0152426 | A1 * | 6/2008 | Liu et al. | 404/1 |
| 2009/0010711 | A1 * | 1/2009 | Yin | 404/1 |

FOREIGN PATENT DOCUMENTS

| | | | |
|---|---|---|---|
| CN | 1389627 | A | 1/2003 |
| CN | 2791097 | Y | 6/2006 |
| CN | 100447336 | C | 12/2008 |
| JP | 2005 256578 | A | 9/2005 |

OTHER PUBLICATIONS

Steinmetz, Katy, A New Turn Ahead on U.S. Highways, Imported From France, Feb. 7, 2011, Time Magazine.*

(Continued)

*Primary Examiner* — Abigail A Risic
(74) *Attorney, Agent, or Firm* — Charles C. Kinne; Mary E. Adams; Kinne IP Group, P.C.

(57) ABSTRACT

A crossover for travel paths is provided. The crossover includes a primary travel path having a first pathway arranged for travel in a first direction and a second pathway arranged for travel in a second direction, and a secondary travel path having a third pathway arranged for travel in a third direction and a fourth pathway arranged for travel in a fourth direction. A main bridge crossover is provided so that the first and second pathways cross each of the third and fourth pathways without intersecting at grade. Two minor bridge crossovers are provided, each constructed and arranged so that the third and fourth pathways cross each other without intersecting, at grade. Lane communication is provided between select exits and entrances to minimize weaving traffic patterns, additional flyovers are minimized and no 270-degree loops are required, providing continuous traffic flow.

9 Claims, 31 Drawing Sheets

(56) References Cited

OTHER PUBLICATIONS

Alternative Intersections/Interchanges: Informational Report (AIIR), Publication No. FHWA-HRT-09-060, Research, Development, and Technology, Turner-Fairbank Highway Research Center, Apr. 2010.

Missy Shelton, "Diverging Diamond" Traffic Flow: Way of the Future, , National Public Radio (NPR), Nov. 24, 2009.

Scott Wolf, PE, PLS, Diverging Diamond Interchange 101, 14th Annual ACEC-KY FHWA KYTC Partnering Conference, U.S. Department of Transportation—Federal Highway Administration, Aug. 11, 2009.

Nterchanges Design, Chapter 1360, Route Continuity, WSDOT Design Manual, M 22-01.05, Jun. 2009.

Mark Doctor, George Merritt and Steve Moler, Designing Complex Interchanges, FHWA HRT-10-001, vol. 73, No. 3, Nov./Dec. 2009.

American Association of State Highway and Transportation Officials (AASHTO), Geometric Design of Highways ad Streets, Chapter 3—Elements of Design, Traveled Way Widening on Horizontal Curves, 2004.

NCHRP 674, Crossing Solutions at Roundabouts and Channelized Turn Lanes for Pedestrians with Vision Disabilities, National Cooperative Highway Research Program, 2011.

AASHTO (American Association of State Highway & Transportation Officials) Green Book.

Transportation Research Board, Highway Capacity Manual, Chapter 13, Freeway Merge and Diverge Segments, 2010, ISBN 978-0-309-16077-3.

Missy Shelton, "Diverging Diamond" Traffic Flow: Way of the Future, National Public Radio (NPR), , Nov. 24, 2009.

Interchanges Design, Chapter 1360, Route Continuity, WSDOT Design Manual, M 22-01.05, Jun. 2009.

Mark Doctor, George Merritt and Steve Moler, Designing Complex Interchanges, FHWA-HRT-10-001, vol. 73, No. 3, Nov./Dec. 2009.

* cited by examiner

DOUBLE CROSSOVER MERGING INTERCHANGE

CROSS-REFERENCE TO RELATED APPLICATIONS

This application relates to and claims priority from U.S. Provisional Patent Application Ser. No. 61/506,032, filed Jul. 9, 2011.

FIELD OF THE INVENTION

This disclosure relates to improvements in an interchange. In particular, the disclosure provides an improved and simplified construction of an interchange having many of the advantages and features shown in the prior art but having few of the limitations of the prior art, in a concise, vastly less expensive design. Even more particularly, the disclosure relates to providing an interchange having a compressed footprint, as at-grade signal-controlled interchanges have provided, while at the same time providing an interchange that significantly reduces at-grade conflict and lane weaving.

BACKGROUND OF THE INVENTION

There is a need for an interchange having a compressed footprint, as at-grade signal-controlled interchanges have provided, while at the same time providing an interchange that significantly reduces at-grade conflict and lane weaving.

Thus, a problem associated with interchanges that precede the present disclosure is that they do not provide, in combination with the other features and advantages disclosed herein, an interchange having a compact footprint that can be built at minimal construction costs, particularly as regards acquiring right-of-way.

Yet another problem associated with interchanges that precede the present disclosure is that they do not provide, in combination with the other features and advantages disclosed herein, an interchange having substantially few or no at-grade conflict, significantly reducing or eliminating the need for signal controlled intersections.

Still a further problem associated with interchanges that precede the present disclosure is that they do not provide, in combination with the other features and advantages disclosed herein, an interchange significantly reducing or eliminating the weaving traffic patterns that can accompany merging traffic on high-volume installations.

An additional problem associated with interchanges that precede the present disclosure is that they do not provide, in combination with the other features and advantages disclosed herein, an interchange that can provide the free-flowing traffic patterns most advantageous to adaptation with today's highways.

Yet a further problem associated with interchanges that precede the present disclosure is that they do not provide, in combination with the other features and advantages disclosed herein, an interchange having fewer flyover bridges than those configured into more modern interchanges.

An even further problem associated with interchanges that precede the present disclosure is that they do not provide, in combination with the other features and advantages disclosed herein, an interchange significantly eliminating the need for cloverleaf turns or other 270-degree traffic patterns.

There is a demand, therefore, to overcome the foregoing problems while at the same time providing an interchange that is constructed and arranged to be built at a reasonable cost, particularly in view of its capabilities.

SUMMARY OF THE INVENTION

In a preferred embodiment, a crossover for travel paths is provided. The crossover includes a primary travel path having a first pathway arranged for travel in a first direction and a second pathway arranged for travel in a second direction, and a secondary travel path having a third pathway arranged for travel in a third direction and a fourth pathway arranged for travel in a fourth direction. A main bridge crossover is provided and is constructed and arranged so that the first and second pathways cross each of the third and fourth pathways without intersecting at grade. A pair of minor bridge crossovers is provided and are constructed and arranged so that the third and fourth pathways cross each other without intersecting at grade.

In a more preferred embodiment, the minor bridge crossovers are each adapted to provide lane communication between select exits and entrances, so that no weaving traffic patterns emerge, no additional flyovers are needed and no 270-degree loops are required, while at the same time traffic flow is continuous and can be free of signal control.

In a most preferred embodiment, the crossover is configured as a highway interchange.

Thus, it is an object of the present disclosure to provide, in combination with the other features and advantages disclosed herein, an interchange that is constructed and arranged to have a compressed footprint, as at-grade signal-controlled interchanges have provided, while at the same time providing an interchange that significantly reduces at-grade conflict and lane weaving.

Still a further object of the present disclosure to provide, in combination with the other features and advantages disclosed herein, an interchange that is constructed and arranged to provide a compact footprint, that can be built at minimal construction costs, particularly as regards acquiring right-of-way.

An even further object of the present disclosure to provide, in combination with the other features and advantages disclosed herein, an interchange that is constructed and arranged to have substantially few or no at-grade conflict, significantly reducing or eliminating the need for signal controlled intersections.

Yet an additional object of the present disclosure to provide, in combination with the other features and advantages disclosed herein, an interchange that significantly reduces or eliminates weaving traffic patterns that can accompany merging traffic on high-volume installations.

An additional further object of the present disclosure to provide, in combination with the other features and advantages disclosed herein, an interchange that provides the free-flowing traffic patterns most advantageous to adaptation with today's highways.

Still an even further object of the present disclosure to provide, in combination with the other features and advantages disclosed herein, an interchange that provides fewer flyover bridges than those configured into more modern interchanges.

An even further object of the present disclosure is to provide, in combination with the other features and advantages disclosed herein, an interchange that significantly eliminates the need for cloverleaf turns or other 270-degree traffic patterns.

Thus, an interchange having the above-mentioned features and advantages is provided, overcoming the foregoing problems while at the same time providing an interchange that is constructed and arranged to be built at, a reasonable cost, particularly in view of its capabilities.

BRIEF DESCRIPTION OF THE DRAWINGS

In the detailed description that follows, reference will be made to the following figures.

DETAILED DESCRIPTION OF PREFERRED EMBODIMENTS

Considerations in Interchange Design

Referring now to FIGS. 1 through 9, a number of efforts in the past to provide traffic control interchanges have been implemented, particularly on motor vehicle highways.

Figure 1:
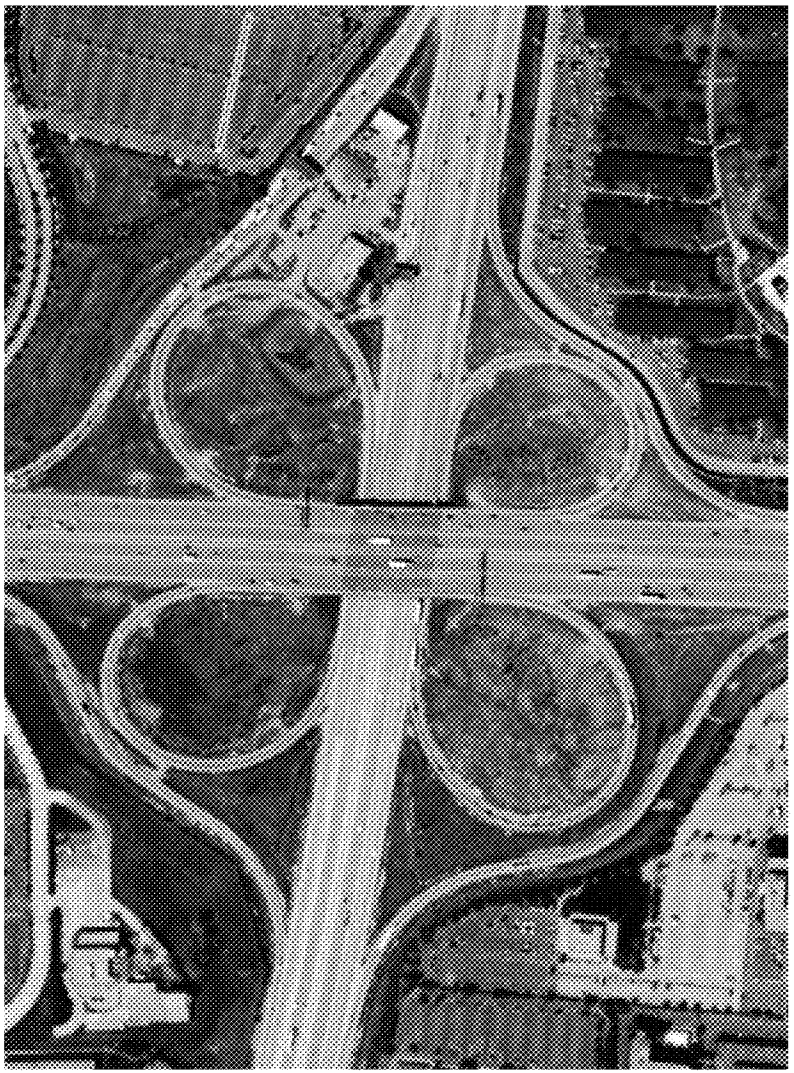
FIG. 1 is a photographic illustration of a prior art, cloverleaf interchange.
Figure 2:
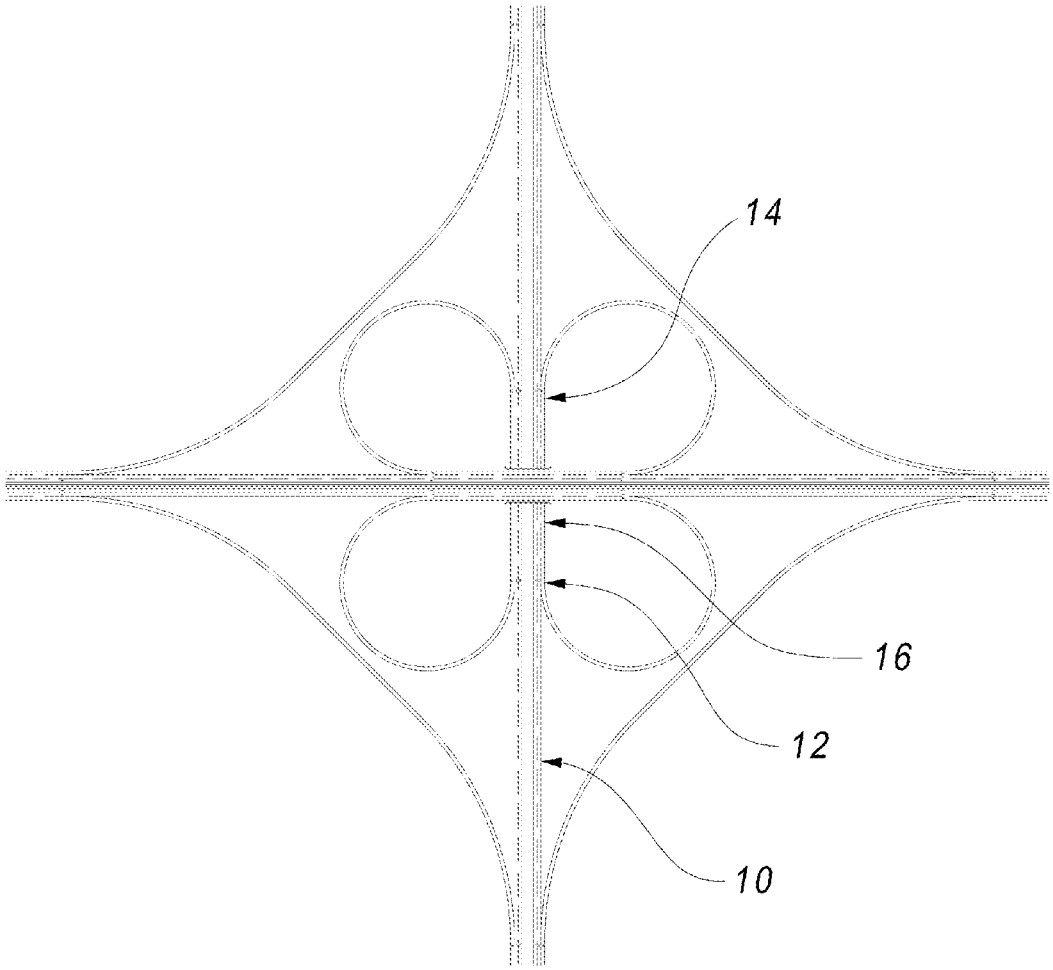
FIG. 2 is a schematic illustration of a prior art, cloverleaf interchange.

As shown in FIG. 1, a traditional cloverleaf is provided to connect two highways constructed for substantial traffic volume and vehicular speed. An advantage of this approach is that only one bridge must be built. The interchange provides free-flow operations for vehicular traffic. Referring now to FIG. 2, drawbacks of this design can be seen. These include that a relatively large footprint is required for the construction of the interchange, and further that vehicles seeking to enter the highway 10 at entrance 12 must conflict with those seeking to exit the same highway 10 at exit 14. As shown, vehicles entering at 12 must change lanes to the left to go straight, whereas vehicles exiting at 14 must change lanes to the right to exit, creating a section 16 of the highway 10 in which weaving occurs. This weaving impedes smooth flow of traffic, thereby impairing the load capacity and design speed of the interchange.

Figure 3:
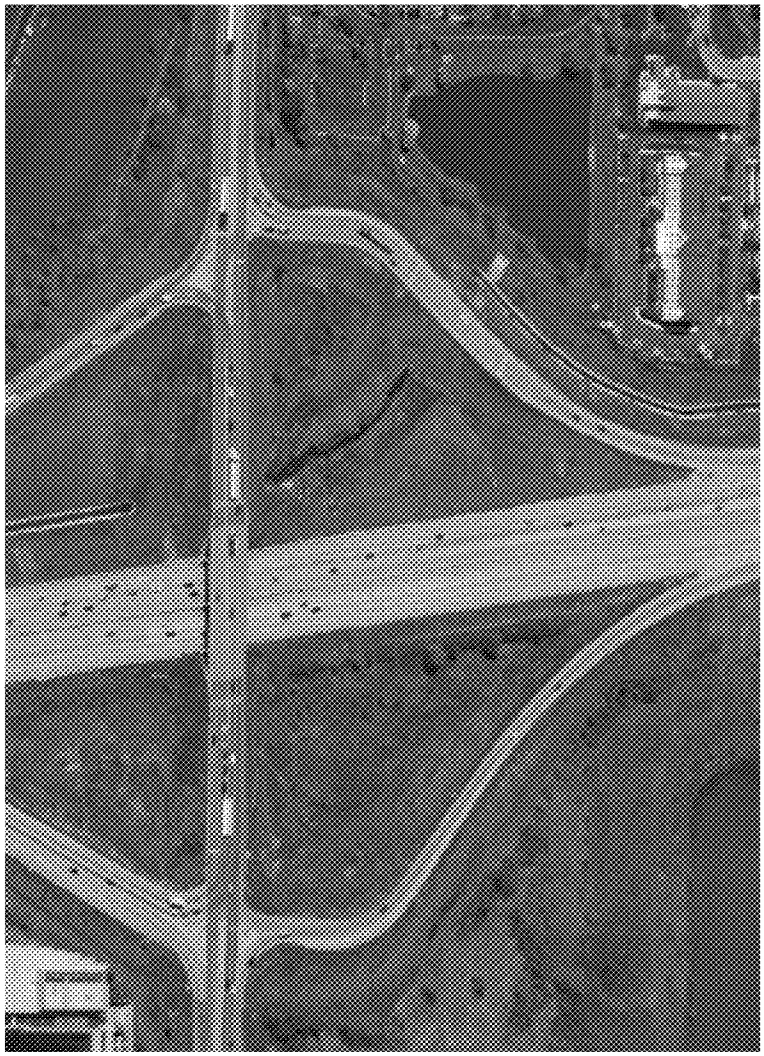
FIG. 3 is a photographic illustration of a prior art, at-grade diamond interchange.
Figure 4:
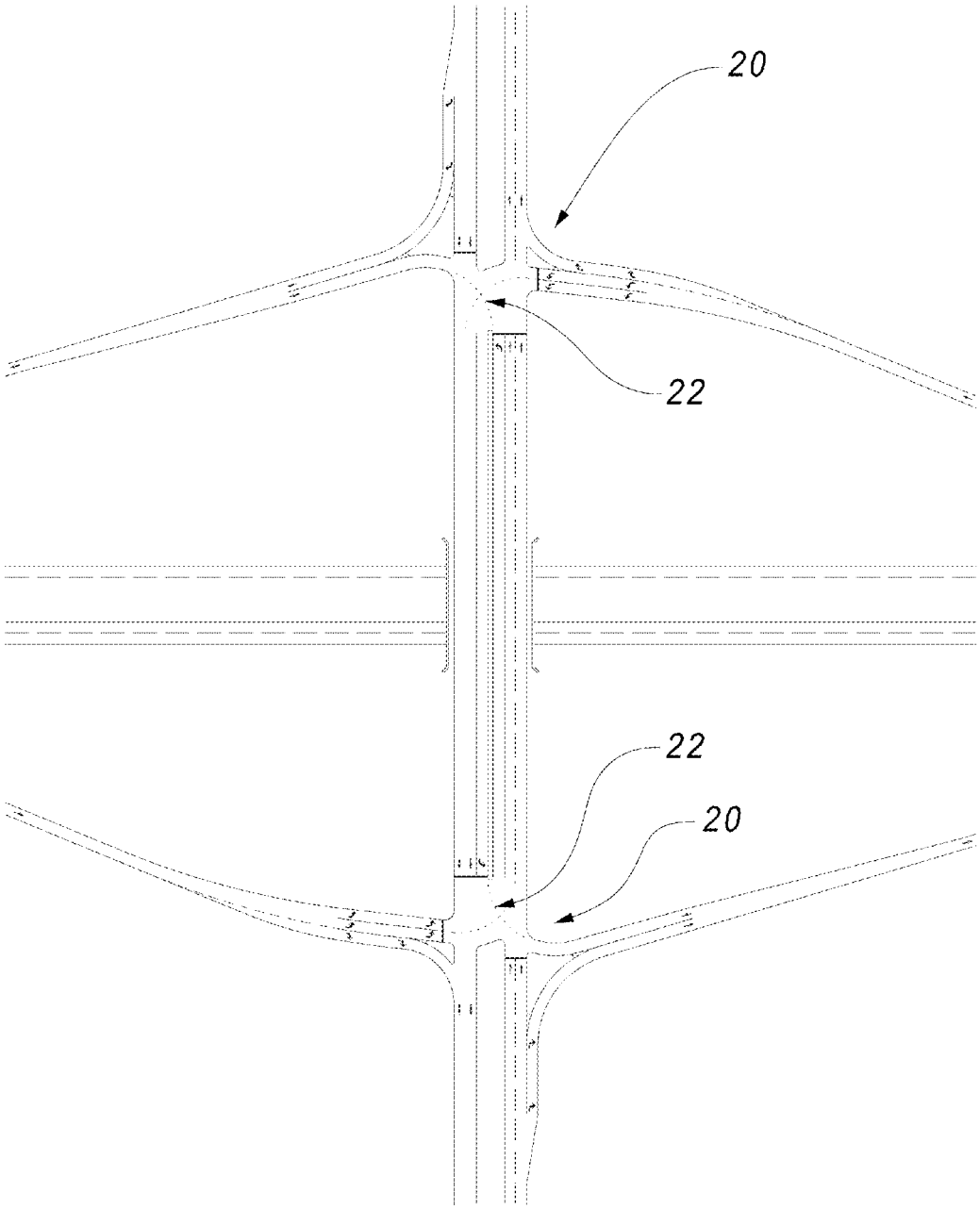
FIG. 4 is a schematic illustration of a prior art, at-grade diamond interchange.

Referring next to FIGS. 3, an at-grade diamond interchange is provided. Again, as in the cloverleaf interchange, only one bridge must be built. The interchange does not provide free-flow operation for all vehicular traffic but it does provide for accommodating a smaller footprint. Referring now to FIG. 4, drawbacks of this design can be seen. These include that the intersections 20 must include traffic signals 22 to regulate traffic, stopping traffic on the exits at times and impeding the smooth flow of traffic, thereby impairing the load capacity and design speed of the interchange.

Figure 5:
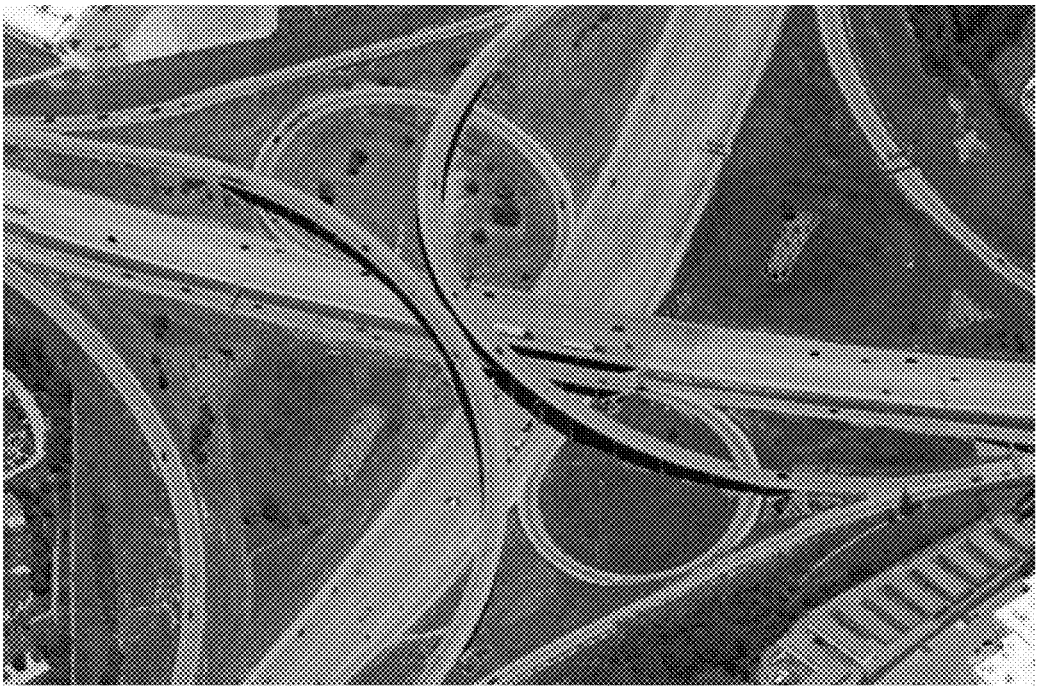
FIG. 5 is a photographic illustration of a prior art, cloverstack fly-over interchange.
Figure 6:
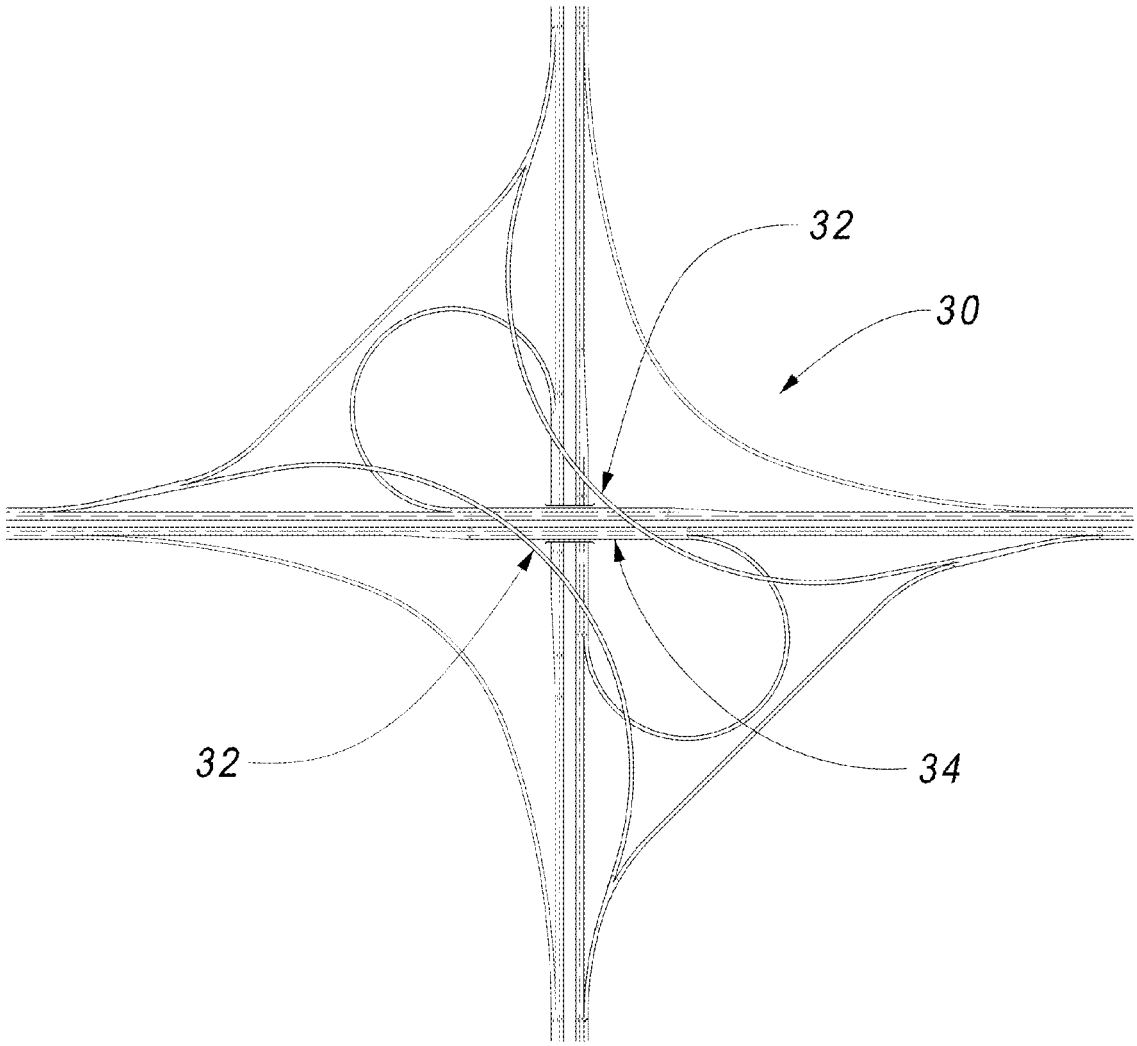
FIG. 6 is a schematic illustration of a prior art, cloverstack fly-over interchange.

Still a further effort to provide an interchange is shown at FIG. 5. This illustrates a clover-stack interchange. An advantage of this approach is that weaving is eliminated and the interchange provides free-flow operations for vehicular traffic. Referring now to FIG. 6, drawbacks of this design can be seen. These include that a large footprint is still required for the construction of the interchange 30, and further that additional bridges 32 must be provided that are substantially longer than the typical main bridge 34 would be, increasing the relative cost of building such an interchange. Moreover, while less expensive to build than a directional interchange, infra., these would be substantially more expensive to build than a diamond or cloverleaf interchange. Finally, the additional bridges 32 would typically be constructed to have a slower vehicular design speed than a fly-over design, thereby impairing the load capacity and design speed of the interchange.

Figure 7:
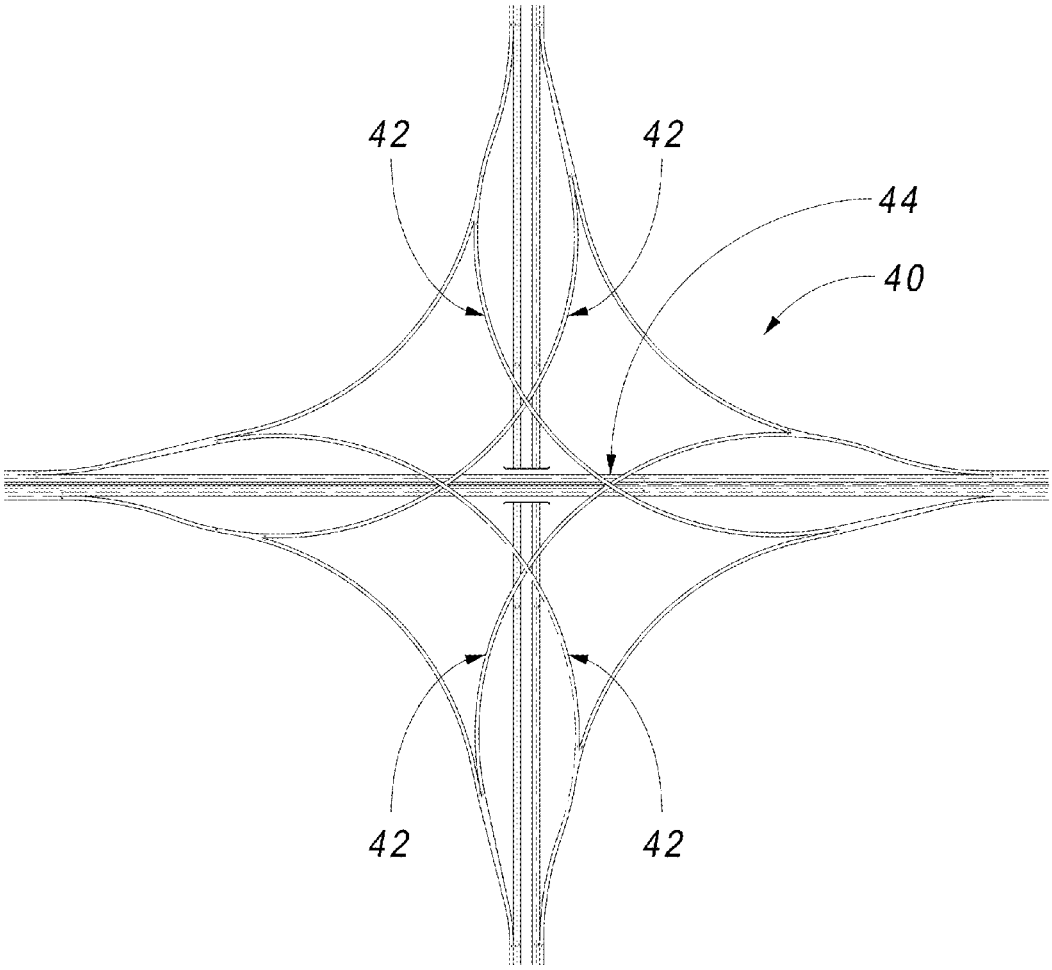
FIG. 7 is a schematic illustration of a prior art, flyover interchange.

Another effort to provide an interchange is shown at FIG. 7, illustrating a directional interchange 40. An advantage of this approach is that weaving is eliminated, the interchange provides free-flow operations for vehicular traffic and higher design speeds are provided. Drawbacks of this design include that the interchange 40 requires four additional bridges 42 that are substantially longer than the typical main bridge 44 would be and that two of the additional bridges 42 must each pass over another additional bridge 42, thereby creating additional elevations and complexity to the interchange. This interchange would be very expensive to build relative to the other structures of the prior art.

As traffic demands continue to rise, the need for innovative traffic control devices continues to grow as well. Often, the type of intersection control is an essential key component of a safe and efficient traffic control system or network. One method of addressing this need has been the use of less conventional intersection types. Many of these less conventional intersection types have been implemented successfully for many years in various geographic locations throughout the United States and abroad. These less used intersection types are commonly referred to as "Alternative Intersection Control."

Figure 8:
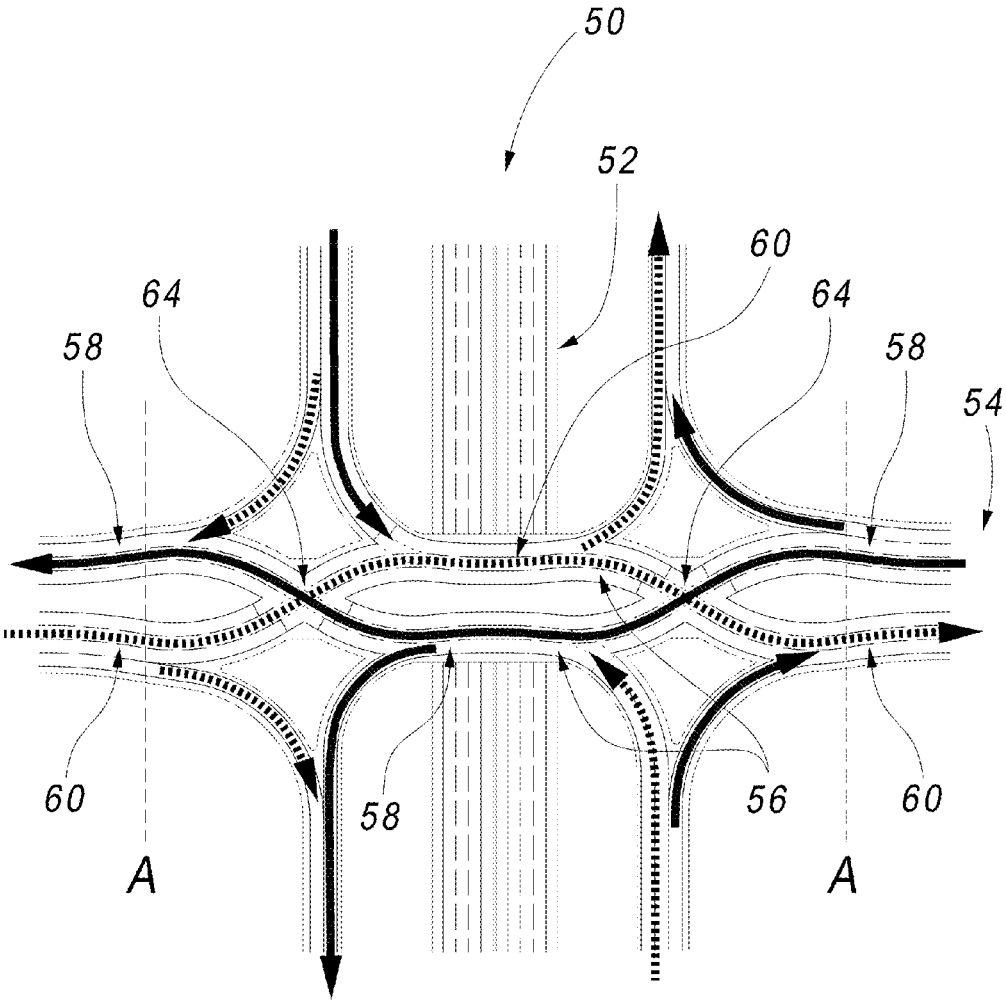
FIG. 8 illustrates an interchange having an at-grade, double crossover diamond (DCD) configuration.
Figure 9:
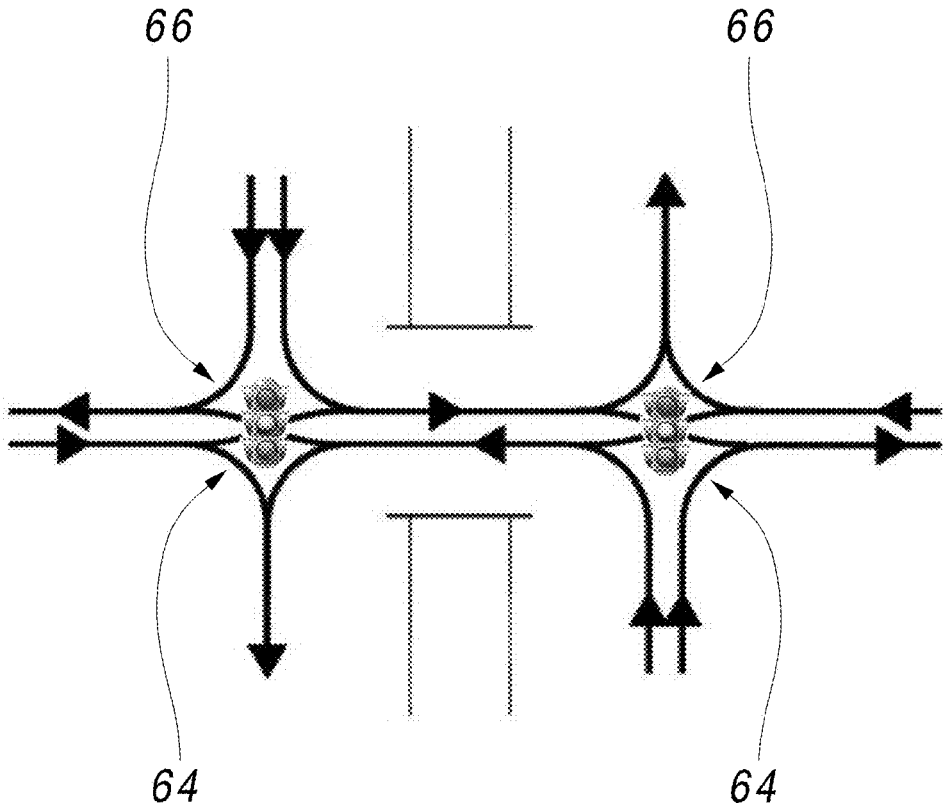
FIG. 9 is a schematic illustration of an interchange having two-phase traffic signal placement.

One such alternative intersection control is called a Double Crossover Diamond (DCD) or a Diverging Diamond Interchange (DDI). As illustrated in FIGS. 8 and 9, the DCD provides a reversal of the directional traffic movement on the crossing arterial roadway through the interchange area. At a conventional diamond interchange, left turns are executed across the path of opposing traffic. By flipping the traffic streams within the interchange area, the conflict between the left turn and the major road can be removed. Left turning traffic from the minor road onto an on-ramp to the freeway (major) can be made without conflict from the opposing traffic. See generally ALTERNATIVE INTERSECTIONS/INTERCHANGES: INFORMATIONAL REPORT (AIIR), Publication No. FHWA-HRT-09-060, Research, Development, and Technology, Turner-Fairbank Highway Research Center, April 2010.

Although it is less common in the United States, the DCD has been effectively used in France, first being constructed during the 1970s. "DIVERGING DIAMOND" TRAFFIC FLOW: WAY OF THE FUTURE, Missy Shelton, National Public Radio (NPR), Nov. 24, 2009. The DCD uses at-grade traffic signals to crossover traffic streams, as shown generally in FIGS. 8 and 9. DIVERGING DIAMOND INTERCHANGE 101, 14$^{th}$ Annual ACEC-KY FHWA KYTC Partnering Conference, Scott Wolf, PE, PLS, U.S. Department of Transportation—Federal Highway Administration, Aug. 11, 2009.

Thus, as shown in FIG. 8, an interchange 50 of a primary highway 52 and a secondary highway 54 includes a bridge 56 providing an overpass so that the two highways do not intersect at grade. The secondary highway 54 includes two directional paths 58, 60 extending along its length. A crossover region 62 is located at A-A on the secondary highway 54 and is provided with two at-grade intersections 64, each constructed and arranged to reverse the respective locations of the directional paths 58, 60 so that they are in opposite relation to each other in the crossover region 62 compared to their respective relation outside the crossover region 62. As shown schematically in FIG. 9, traffic control devices 66 are required near the intersections 64 to regulate and control traffic.

Figure 10:
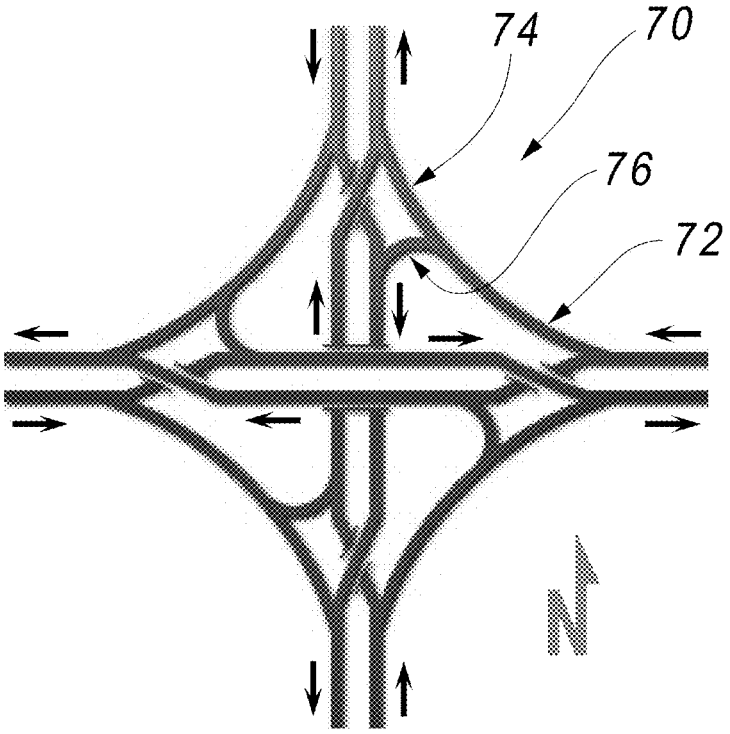
FIG. 10 is a schematic illustration of a divergent windmill junction interchange.

FIG. 10 is a schematic illustration of a divergent windmill junction interchange 70. This provides for crossing over each of the two highways that intersect. As shown, this conceptual design proposes diverging all exiting westbound traffic to the right 72 and splits northbound traffic 74 from southbound traffic 76, providing a left-hand exit for the southbound traffic (other directional traffic is handled in like fashion). This configuration requires five bridges and a relatively large footprint for construction.

Figure 11:
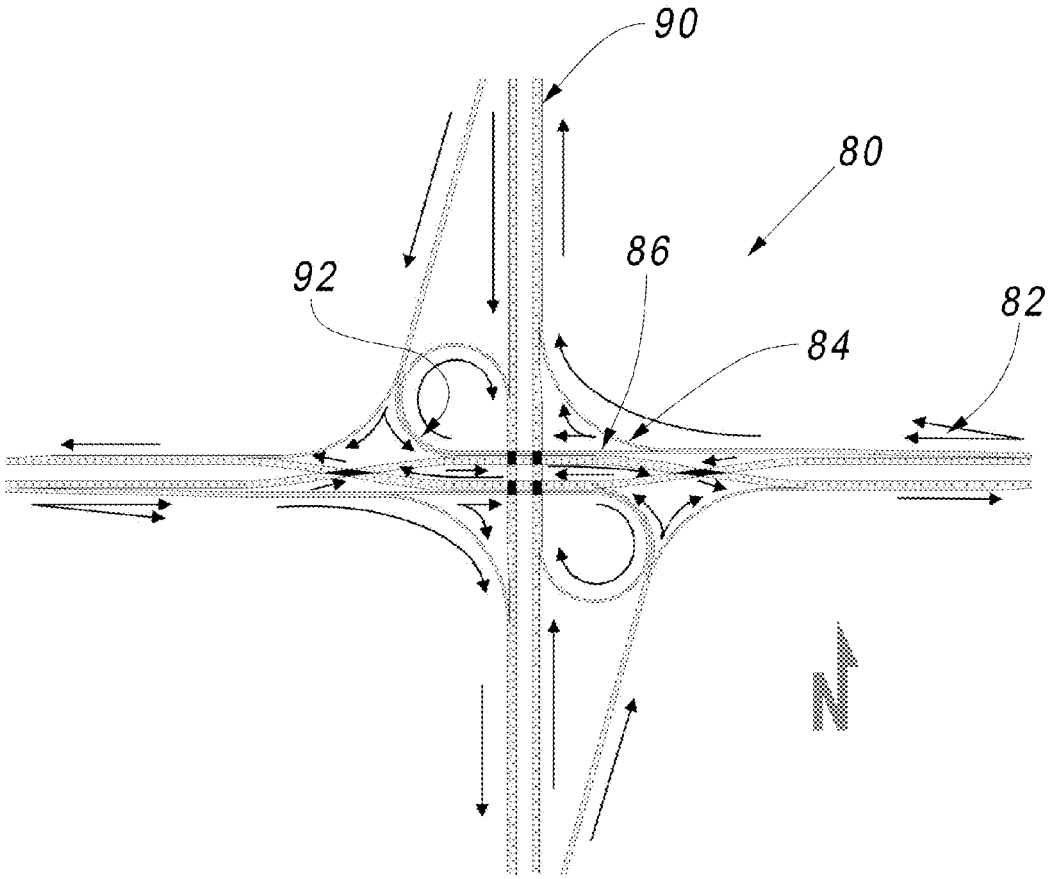
FIG. 11 is a schematic illustration of a diverging partial cloverleaf interchange.

FIG. 11 is a schematic illustration of a diverging partial cloverleaf interchange 80. This provides for crossing over only one of the two highways that intersect. As shown, this conceptual design proposes diverging all exiting westbound traffic to the right 82 and provides a northbound traffic exit 84, maintaining the southbound-intending traffic 86 in a westerly direction across the major highway 90 and then providing a loop ramp exit to the right 92, thereby requiring a cloverleaf and requiring the exiting traffic to turn to the right 270 degrees. This provides a right-hand exit for the southbound traffic (eastbound directional traffic is handled like fashion). This configuration also requires a relatively wider bridge for loop traffic to travel over the bridge to the loop ramps, thereby increasing costs.

It is against this backdrop that the current disclosure is provided. While the various interchanges discussed above offer competing advantages and disadvantages, the current disclosure provides an interchange that is superior to the foregoing in combined considerations of cost, capacity, design speed, free-flow operations and sheer elegance.

The Double Crossover Merging Interchange (DCMI)

Figure 12:
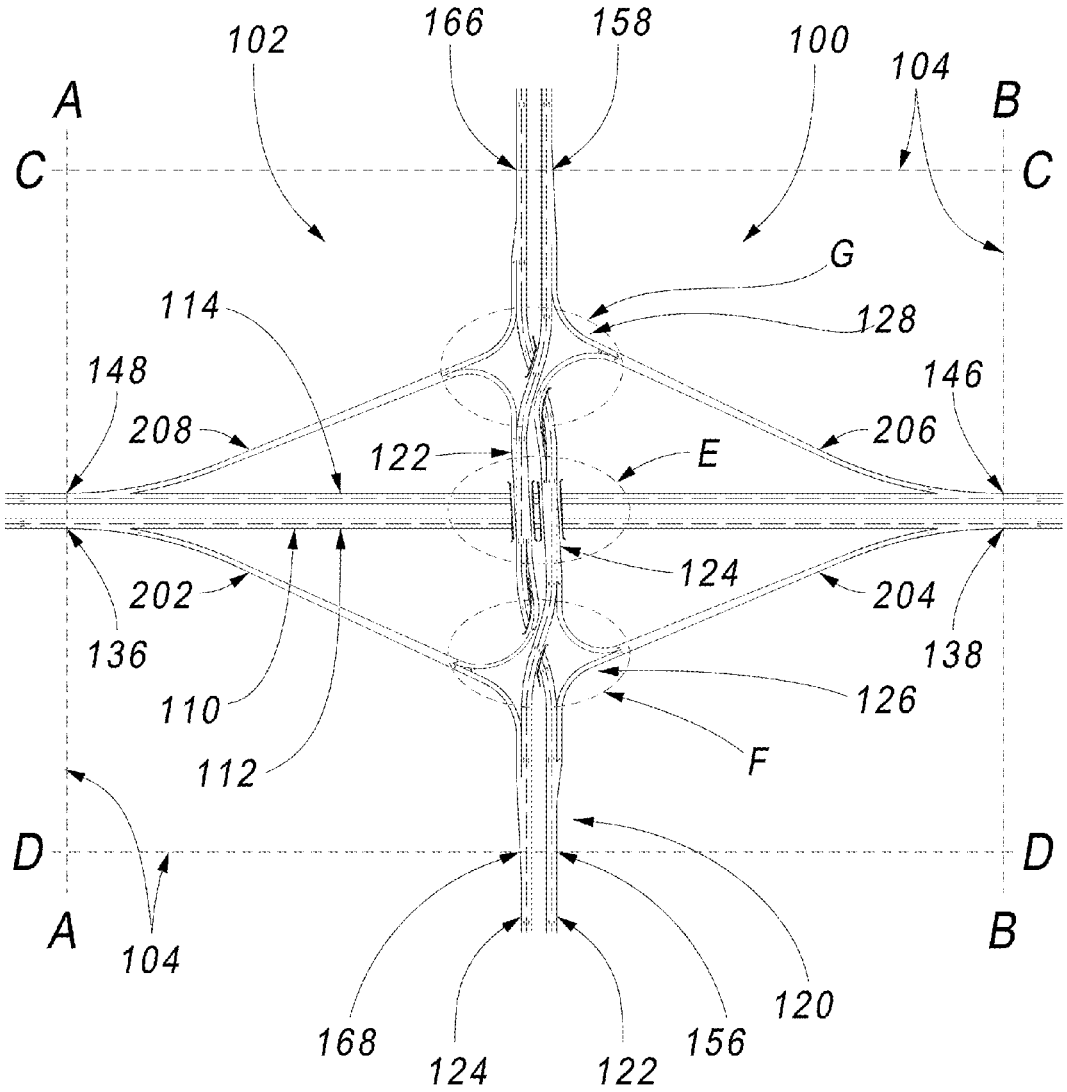
FIG. 12 is an illustration of a preferred embodiment of the disclosure.

Referring now to FIG. 12, a crossover for travel paths 100 is shown. The crossover 100 includes an interchange region 102 bounded by lines A-A, B-B, C-C and D-D delineating an interchange boundary 104 and having a major crossover subregion 106 (shown in FIG. 14) contained within line E centrally disposed therein.

A primary travel path 110 extends through the interchange region 102 and through the major crossover subregion 106. The primary travel path 110 has a first pathway 112 arranged for travel in a first direction and a second pathway 114 arranged for travel in a second direction. Typically, these two directions are substantially opposite one another. The first and second pathways 112, 114 are arranged so as to not cross over one another throughout the interchange region 102.

A secondary travel path 120 has a third pathway 122 arranged for travel in a third direction and a fourth pathway 124 arranged for travel in a fourth direction. Typically, these two directions are substantially opposite one another. The secondary travel path 120 extends through the interchange region 102 and passes sequentially through a first minor crossover subregion 126 contained approximately within line F, the major crossover subregion 106 and a second minor crossover subregion 128 contained approximately within line G. The minor crossover regions 126, 128 are oppositely disposed around the major crossover subregion 106 and are contained within the interchange region 102

Figure 13:
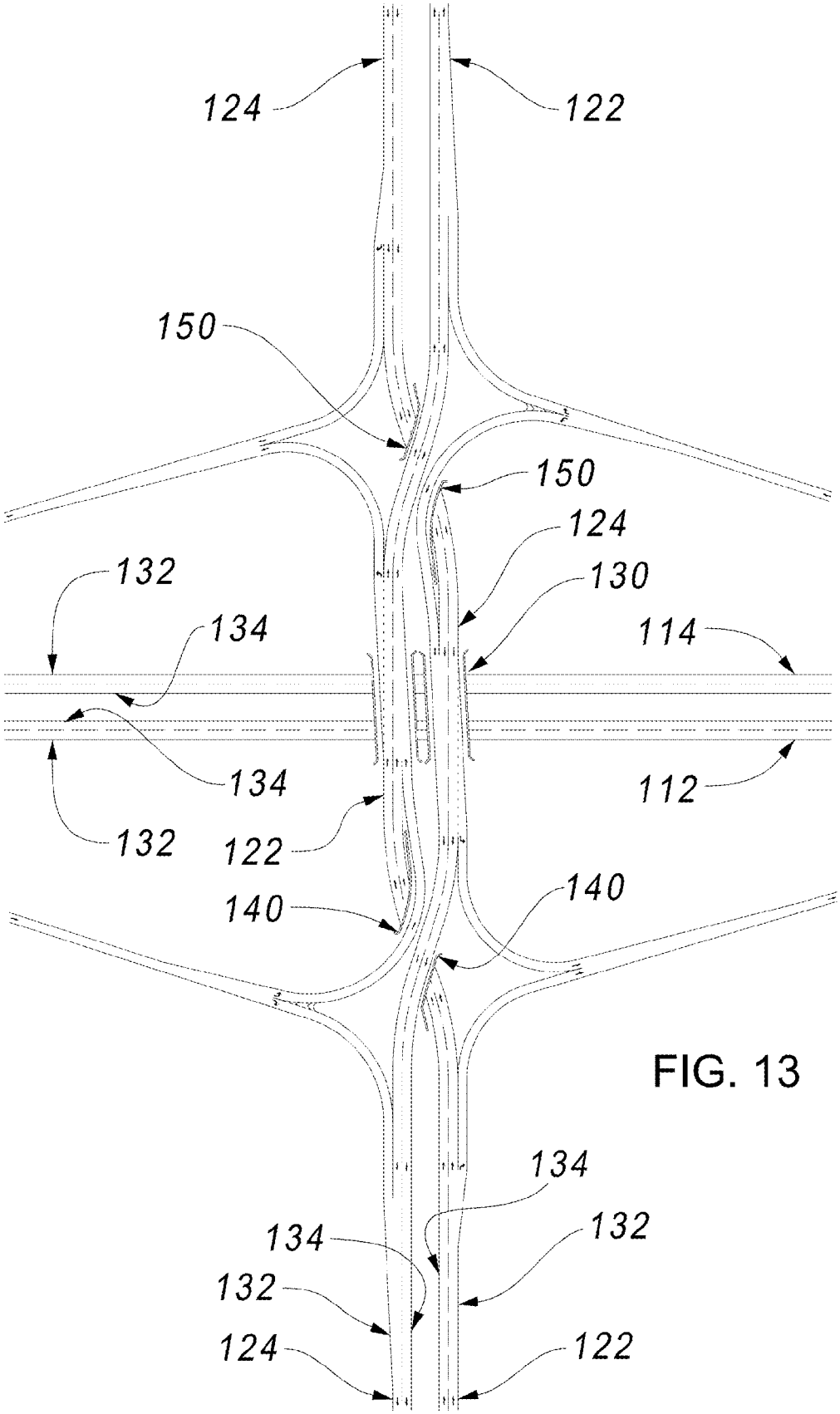
FIG. 13 is an illustration of a portion of a preferred embodiment of the disclosure.

Referring now to FIG. 13, a main bridge crossover 130 is positioned in the main crossover subregion 106 (shown in FIG. 14) and constructed and arranged so that each of the first and second pathways 112, 114 cross each of the third and fourth pathways 122, 124 without intersecting at grade.

A first minor bridge crossover 140 is positioned in the first minor crossover subregion 126 (FIG. 12). The crossover 140 is constructed and arranged so that the third and fourth pathways 122, 124 cross each other without intersecting at grade.

Likewise, a second minor bridge crossover 150 is positioned in the second minor crossover subregion 128 (FIG. 12). The crossover 150 is constructed and arranged so that the third and fourth pathways 126, 128 cross each other without intersecting at grade.

Each pathway 112, 114, 122, 124 has a first side 132 and a second side 134. As drawn, first side 132 is the right side and second side 134 is the left side; this is the preferred embodiment in right-hand drive nations such as the United States and most of the world. However, it is understood that these can be reversed and preferably would be in left-hand drive nations such as England and Japan, so that the first side would refer to the left side and the second side would refer to the right side.

Referring now again to FIG. 12, each pathway passes through the interchange boundary 104 twice, first when entering the interchange region 102 and then when leaving the interchange region 102. For frame of reference, this thereby defines sequentially for each pathway 112, 114, 122, 124, a first pathway terminus and a second pathway terminus. Thus, first pathway 112 has a first pathway terminus 136 and a second pathway terminus 138. Second pathway 114 has a first pathway terminus 146 and a second pathway terminus 148. Third pathway 122 has a first pathway terminus 156 and a second pathway terminus 158. Finally, fourth pathway 124 has a first pathway terminus 166 and a second pathway terminus 168.

Figure 14:
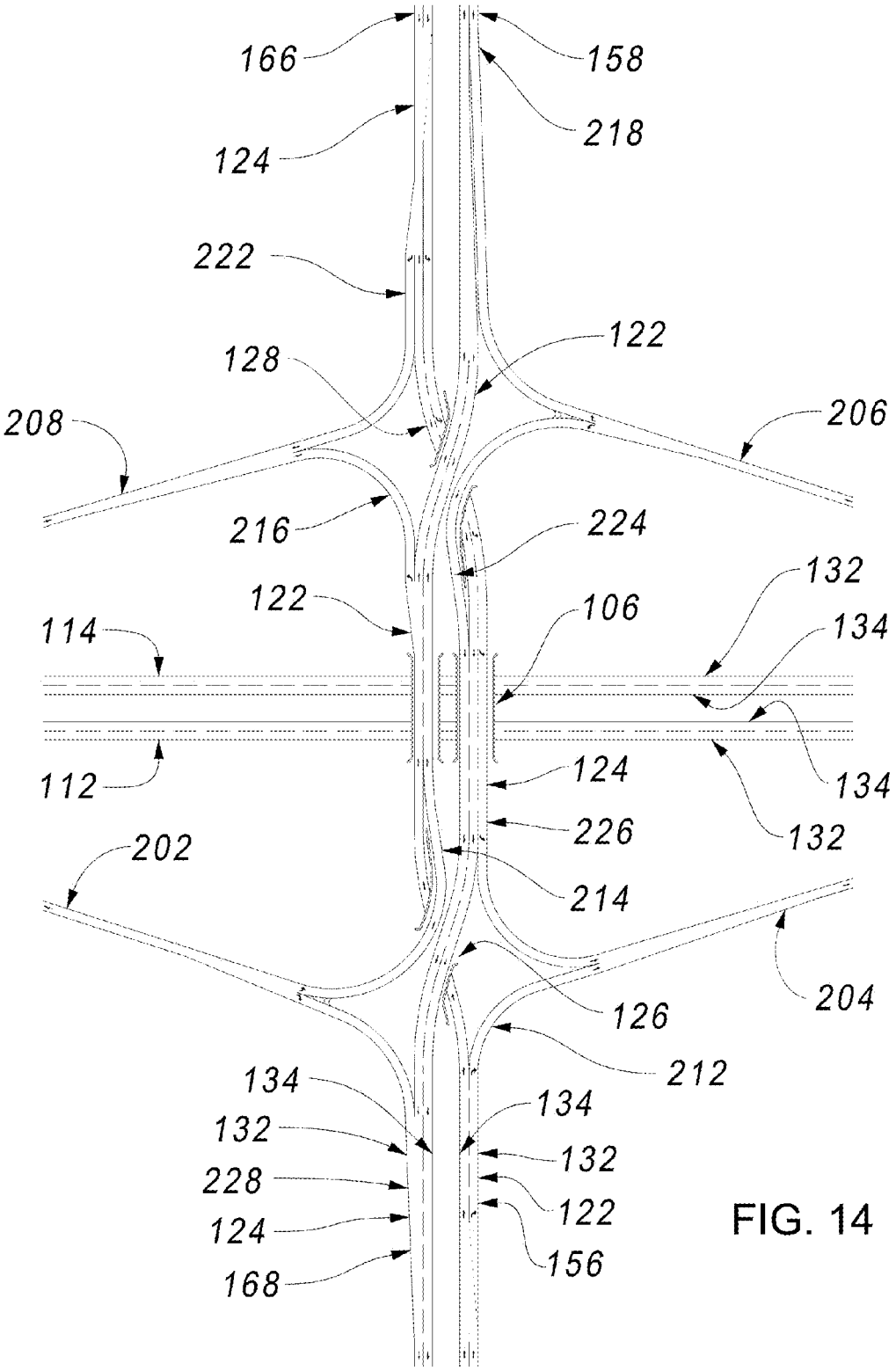
FIG. 14 is an illustration of another preferred embodiment of the disclosure having turning movement and distribution features.

Referring now to FIG. 14, the first pathway 112 has an exit path 202 (shown more fully in FIG. 12) provided on the first side 132 and positioned proximate to the first pathway first terminus 136 (FIG. 12). The first pathway 112 also has an entrance path 204 (shown more fully in FIG. 12) provided on the first side 132 and positioned proximate to the first pathway second terminus 138 (FIG. 12).

Likewise, the second pathway 114 has an exit path 206 (shown more fully in FIG. 12) provided on the first side 132 and positioned proximate to the second pathway first terminus 146 (FIG. 12). The second pathway 114 also has an entrance path 208 (shown more fully in FIG. 12) provided on the first side 132 and positioned proximate to the second pathway second terminus 148 (FIG. 12).

The third pathway 122 has a first exit path 212 provided on the first side 132 and positioned proximate to the third pathway first terminus 156. The third pathway 122 also has a first entrance path 214 provided on the first side 132 and positioned between the first minor crossover subregion 126 and the major crossover subregion 106. Additionally, the third pathway 122 has a second exit path 216 provided on the second side 134 and positioned between the major crossover subregion 106 and the second minor crossover subregion 128. Finally, the third pathway 122 has a second entrance path 218 provided on the first side 132 and positioned proximate to the third pathway second terminus 158.

In similar fashion, the fourth pathway 124 has a first exit path 222 provided on the first side 132 and positioned proximate to the fourth pathway first terminus 166. The fourth pathway 124 also has a first entrance path 224 provided on the first side 132 and positioned between the second minor crossover subregion 128 and the major crossover subregion 106. Additionally, the fourth pathway 124 has a second exit path 226 provided on the second side 134 and positioned between the major crossover subregion 106 and the first minor crossover subregion 126. Finally, the fourth pathway 124 has a second entrance path 228 provided on the first side 132 and positioned proximate to the fourth pathway second terminus 168.

As thus arranged, the first pathway exit path 202 provides communication with the third pathway first entrance path 214. The first pathway exit path 202 provides communication with the fourth pathway second entrance path 228. The second pathway exit path 206 provides communication with the fourth pathway first entrance path 224. The second pathway exit path 206 provides communication with the third pathway second entrance path 218.

The third pathway first exit path 212 provides communication with the first pathway entrance path 204. The third pathway second exit path 216 provides communication with the second pathway entrance path 208. The fourth pathway first exit path 222 provides communication with the second pathway entrance path 208. The fourth pathway second exit path 226 provides communication with the first pathway entrance path 204.

In the embodiment of the foregoing illustrated in FIGS. 12-16, the two minor crossovers are each provided with an additional pathway to facilitate communication between the respective primary travel path exits and corresponding minor travel path entrances. Thus, where the first pathway exit path 202 provides communication with the third pathway first entrance path 214, traffic from the first pathway exit path 202 is routed via an extra pathway on the first minor bridge crossover 140 to communicate with the third pathway first entrance path 214. Likewise, where the second pathway exit path 206 provides communication with the fourth pathway first entrance path 224, traffic from the second pathway exit path 206 is routed via an extra pathway on the second minor bridge crossover 150 to communicate with the third pathway first entrance path 224.

This advance is helpful in keeping costs of construction to a minimum, as the embodiment discloses an interchange requiring only three bridges (and only two bridges more than required by a diverging diamond interchange). Nevertheless, as will be seen, infra., weaving is kept to a minimum as no exits and entrances are in conflict.

Figure 17:
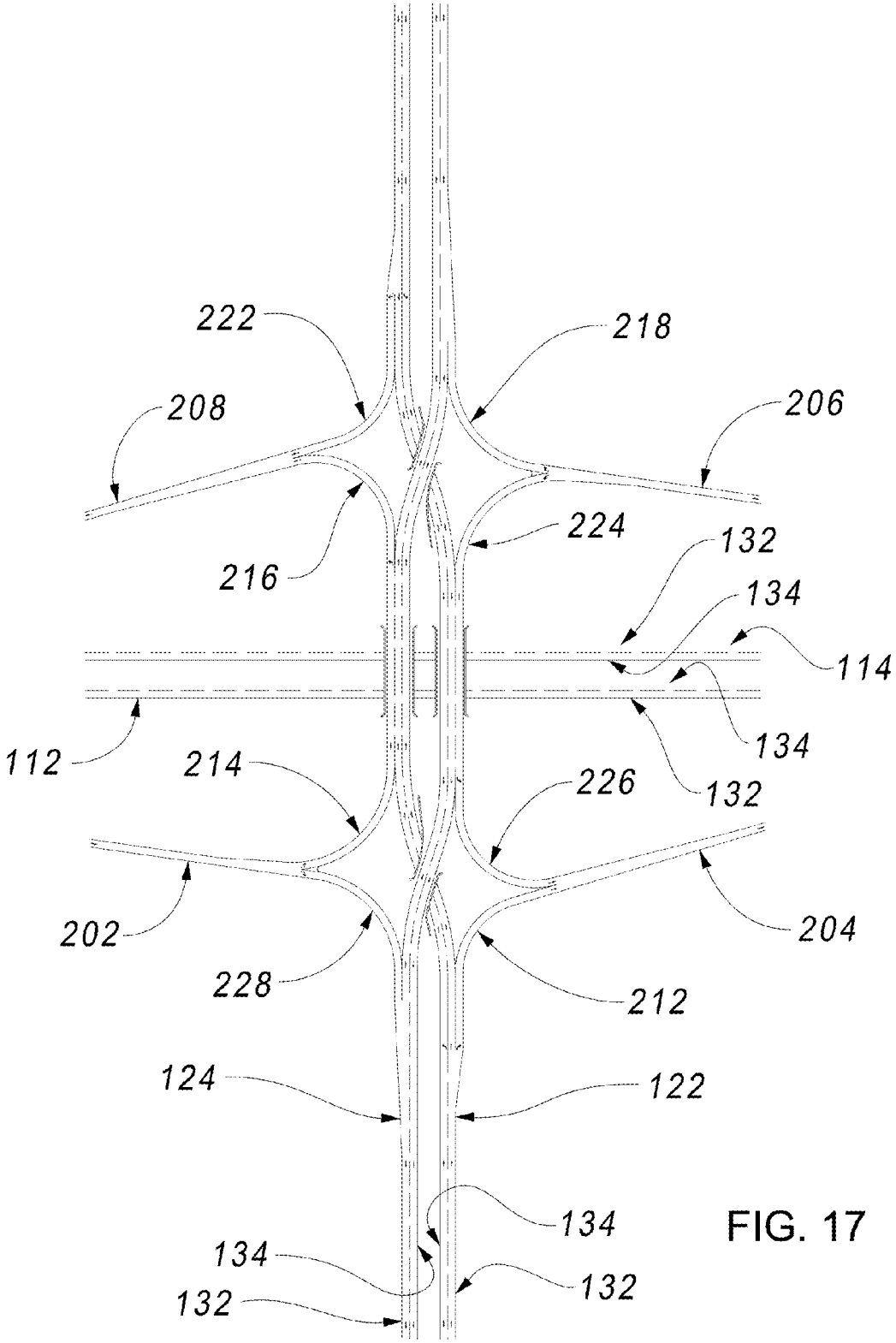
FIG. 17 is an illustration of an additional preferred embodiment of the disclosure.

In FIG. 17, an alternative is shown in which the exits and entrances are not coupled via the minor crossovers. In this embodiment, rather than propose additional bridges or flyovers, some weaving is anticipated, as some of the entrances are disposed to enter from a different side compared to the earlier-described embodiment. Thus, the first pathway 112 has an exit path provided on the first side 132 and an entrance path 204 provided on the first side 132. Likewise, the second pathway 114 has an exit path 206 provided on the first side 132 and an entrance path 208 provided on the first side 132. The third pathway 122 has a first exit path 212 provided on the first side 132, a first entrance path 214 provided on the second side 132, a second exit path 216 provided on the second side 134 and a second entrance path 218 provided on the first side 132. In similar fashion, the fourth pathway 124 has a first exit path 222 provided on the first side 132, a first entrance path 224 provided on the second side 132, a second exit path 226 provided on the second side 134 and a second entrance path 228 provided on the first side 132.

Traffic Volume, Lane Continuity and Other Considerations

To optimize traffic flow on the interchange, traffic volume must be predicted so that the requisite number of lanes can be selected and provided. Thus, one can optimize lane continuity and other considerations affecting the performance of the interchange.

Figure 15:
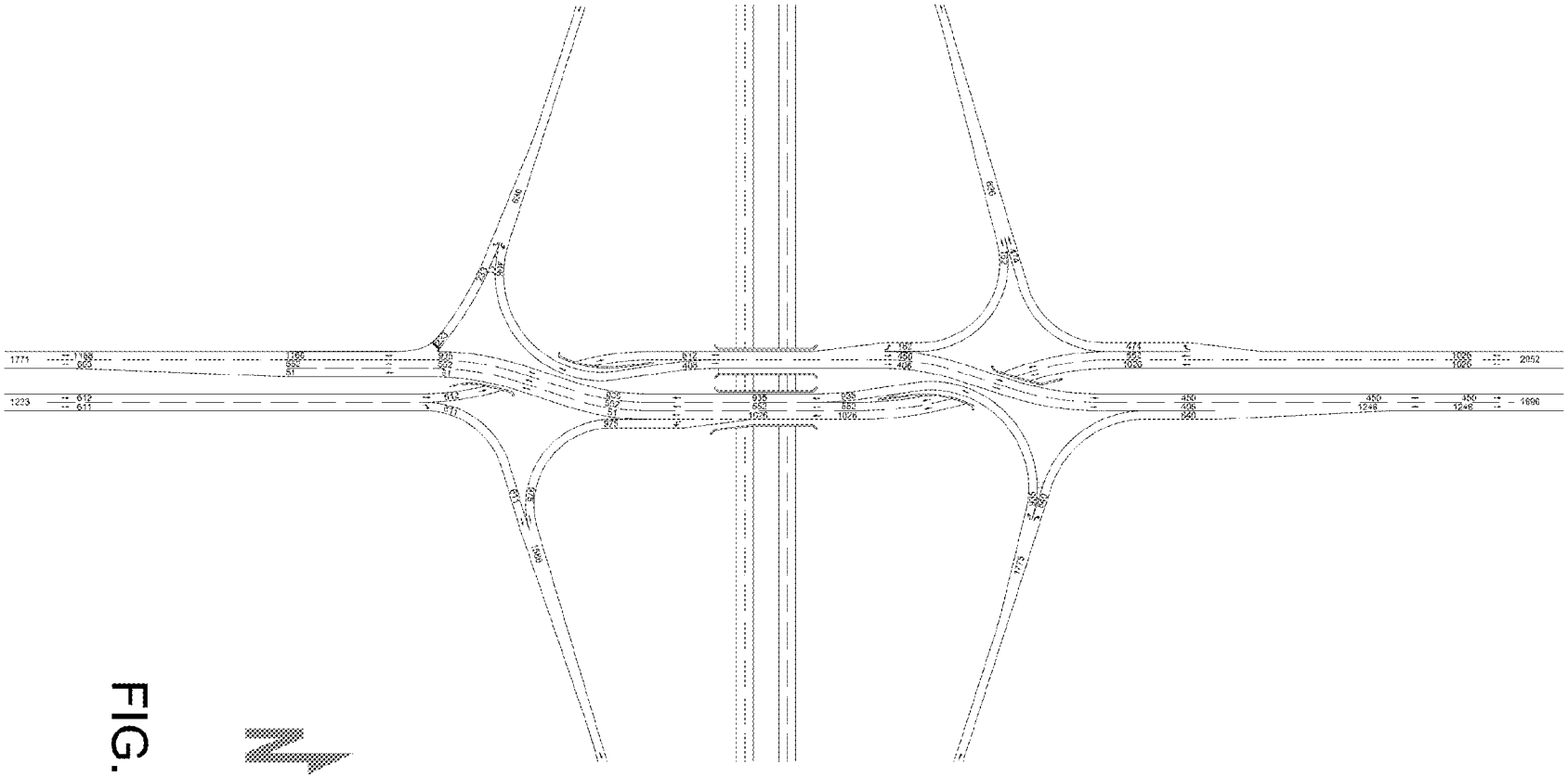
FIG. 15 is an illustration of still another preferred embodiment of the disclosure having lane continuity features and incorporating traffic volume considerations.
Figure 16:
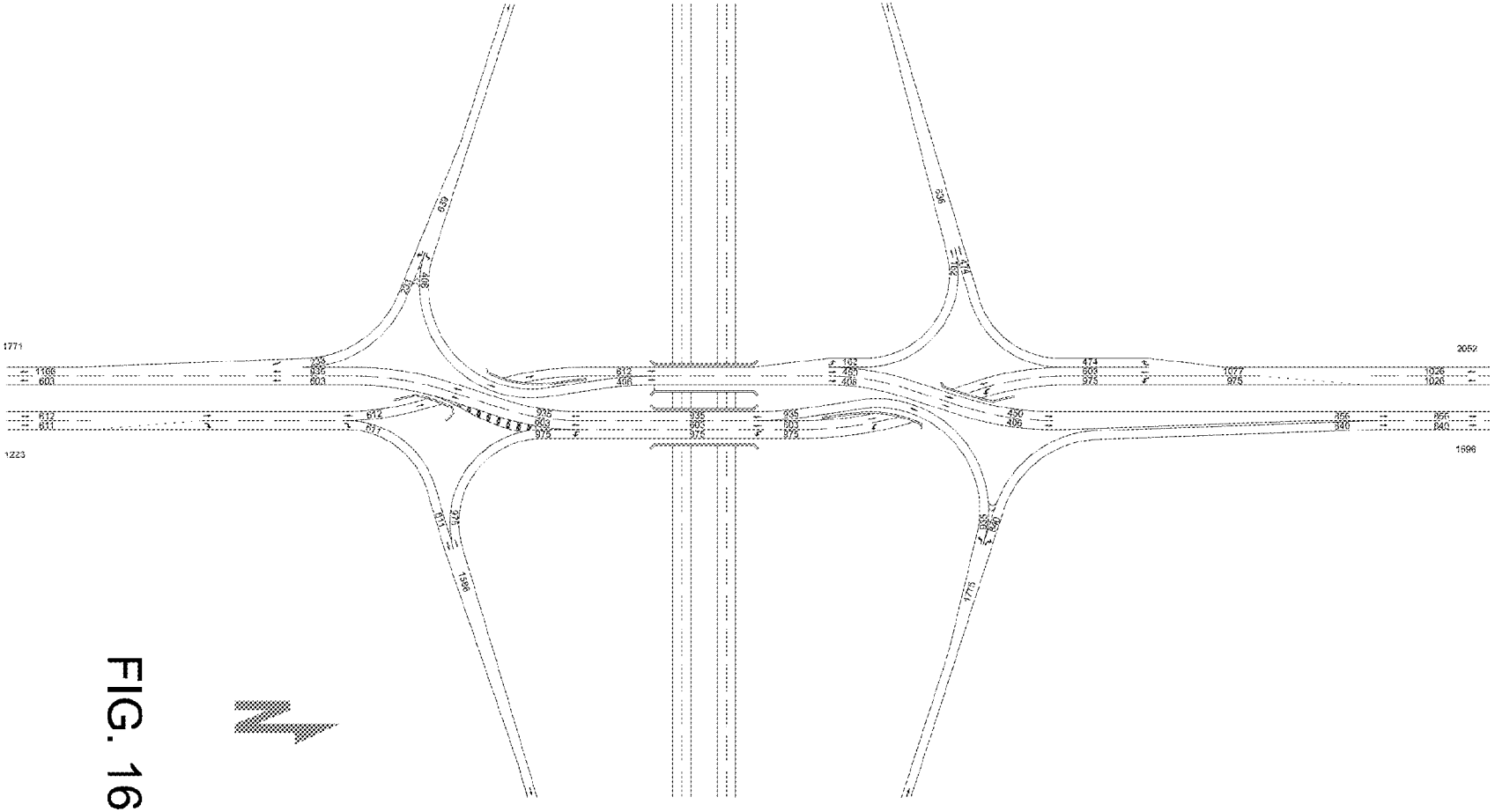
FIG. 16 is an illustration of an even further preferred embodiment of the disclosure illustrating turning movements and distribution with traffic volume.

In FIGS. 15 and 16, traffic volume and lane selection considerations are shown for an interchange having features of the present disclosure as adapted to an automobile highway interchange. Referring first to FIG. 15, a major east-west road is intersected by a minor north-south road, and traffic volume for a pre-determined time period (e.g. one hour) is shown.

Referring first to the east-bound road, 639 vehicles exit on the right on a single lane which splits into two lanes, left and right. In the left lane, 406 vehicles bear left (north) and in the right lane, 235 vehicles bear right (south). 1586 vehicles enter the east-bound road on a single lane formed from the merger of a right and left lane, 611 from the right (south, formerly north-bound) and 975 from the left (north, formerly south-bound).

Next looking at the west-bound road, 1775 vehicles exit on the right on a single lane which splits into two lanes, left and right. In the right lane, 840 vehicles bear right (north) and in the left lane, 935 vehicles bear left (south). 636 vehicles enter the west-bound road on a single lane formed from the merger of two lanes, 162 from the left (south, formerly north-bound) and 474 from the right (north, formerly south-bound).

Examining next the north-bound traffic, 1223 vehicles enter the interchange in two lanes, right and left. The right lane bears to the right (east) and feeds 611 vehicles to the east-bound road. The left lane continues north and passes through the first minor crossover, where it is joined on the right by the lane carrying 406 vehicles exiting the east-bound road to head north. Both of these lanes cross the major crossover, whereupon an exit lane is formed on the left to accommodate the 162 vehicles exiting left to join the west-bound road, leaving 450 north-bound vehicles in the left north-bound lane and 406 vehicles in the right north-bound lane. These two lanes continue over the second minor crossover and are joined on the right by an entrance lane carrying the 840 vehicles exiting the west-bound road to head north. The entering lane merges with the right north-bound lane to carry 1240 vehicles; together with the left north-bound lane's 450 vehicles, 1696 north-bound vehicles exit the interchange.

Examining next the south-bound traffic, 2052 vehicles enter the interchange in two lanes, 1026 in the right lane and 1026 in the left lane. An exit lane is formed to the right and bears to the right (west), feeding 474 vehicles from the right lane to the east-bound road and leaving 552 to continue heading south in the right lane with 1026 vehicles in the left lane. The lanes continue south and pass through the second minor crossover, where they are joined on the right by the lane carrying 935 vehicles exiting the west-bound road to head south. All three of these lanes cross the major crossover, whereupon an exit is formed to the left (east) to accommodate 975 vehicles exiting left to join the east-bound road. All three lanes continue south crossing the first minor crossover, with 51 vehicles in the left lane, 552 vehicles in the center lane and 935 vehicles in the right lane. Thereafter, an entrance lane from the east-bound road merges from the right with the south-bound lanes, carrying the 233 vehicles exiting the east-bound road to travel south, whereupon 1168 vehicles are in the right south-bound lane. Further south, the left-hand of the three south bound lanes, carrying 51 vehicles, merges into the middle south-bound lane, carrying 552, so that 603 vehicles are in the left lane as the south-bound road exits the interchange and 1168 vehicles are in the right lane as the south-bound road exits the interchange.

In FIG. 16, the traffic volumes are the same but the lane selection has been varied. Thus, referring first to the east-bound road, 639 vehicles exit on the right on a single lane which splits into two lanes, left and right. In the left lane, 406 vehicles bear left (north) and in the right lane, 235 vehicles bear right (south). 1586 vehicles enter the east-bound road on a single lane formed from the merger of a right and left lane, 611 from the right (south, formerly north-bound) and 975 from the left (north, formerly south-bound).

Next looking at the west-bound road, 1775 vehicles exit on the right on a single lane which splits into two lanes, and right. In the right lane, 840 vehicles bear right (north) and in the left lane, 935 vehicles bear left (south). 636 vehicles enter the west-bound road on a single lane formed from the merger of two lanes, 162 from the left (south, formerly north-bound) and 474 from the right (north, formerly south-bound).

Examining next the north-bound traffic, 1223 vehicles enter the interchange in two lanes, right and left. The right lane bears to the right (east) and feeds 611 vehicles to the east-bound road. The left lane continues north and passes through the first minor crossover, where it is joined on the right by the lane carrying 406 vehicles exiting the east-bound road to head north. Both of these lanes cross the major crossover, whereupon an exit lane is formed on the left to accommodate the 162 vehicles exiting left to join the west-bound road, leaving 450 north-bound vehicles in the left north-bound lane and 406 vehicles in the right north-bound lane. These two lanes continue over the second minor crossover but are merged to carry 856 vehicles prior to being joined on the right by an entrance lane carrying 840 vehicles exiting the west-bound road to head north. Because the entrance lane does not merge but rather joins the single remaining north-bound lane, and the single remaining north-bound lane has approximately equal traffic volume as the entering lane, less lane-changing will be done and the intersection performs better to carry the 1696 north-bound vehicles out of the interchange.

Likewise examining next the south-bound traffic, 2052 vehicles enter the interchange in two lanes, 1026 in the right lane and 1026 in the left lane. Through signage and lane markings indicating the left lane is for left turns only, cars wishing to continue south-bound move over to the right lane, such that the right lane carries 1077 vehicles and the left lane carries 975 vehicles. An exit lane is formed to the right and bears to the right (west), feeding 474 vehicles from the right lane to the east-bound road and leaving 603 to continue heading south in the right lane with 975 vehicles in the left lane. The two lanes continue south and pass through the second minor crossover, where they are joined on the right by the lane carrying 935 vehicles exiting the west-bound road to head south. All three of these lanes cross the major crossover, whereupon the left lane exits left (east) to accommodate 975 vehicles exiting left to join the east-bound road. Thus, only two lanes need continue south crossing the first minor crossover, as an entire lane is eliminated that only carried 51 vehicles (see FIG. 15). Thereafter, an entrance lane from the east-bound road merges from the right with the south-bound lanes, carrying the 233 vehicles exiting the east-bound road to travel south, whereupon 1168 vehicles are in the right south-bound lane. 603 vehicles are in the left lane as the south-bound road exits the interchange and 1168 vehicles are in the right lane as the south-bound road exits the interchange.

Figure 18:
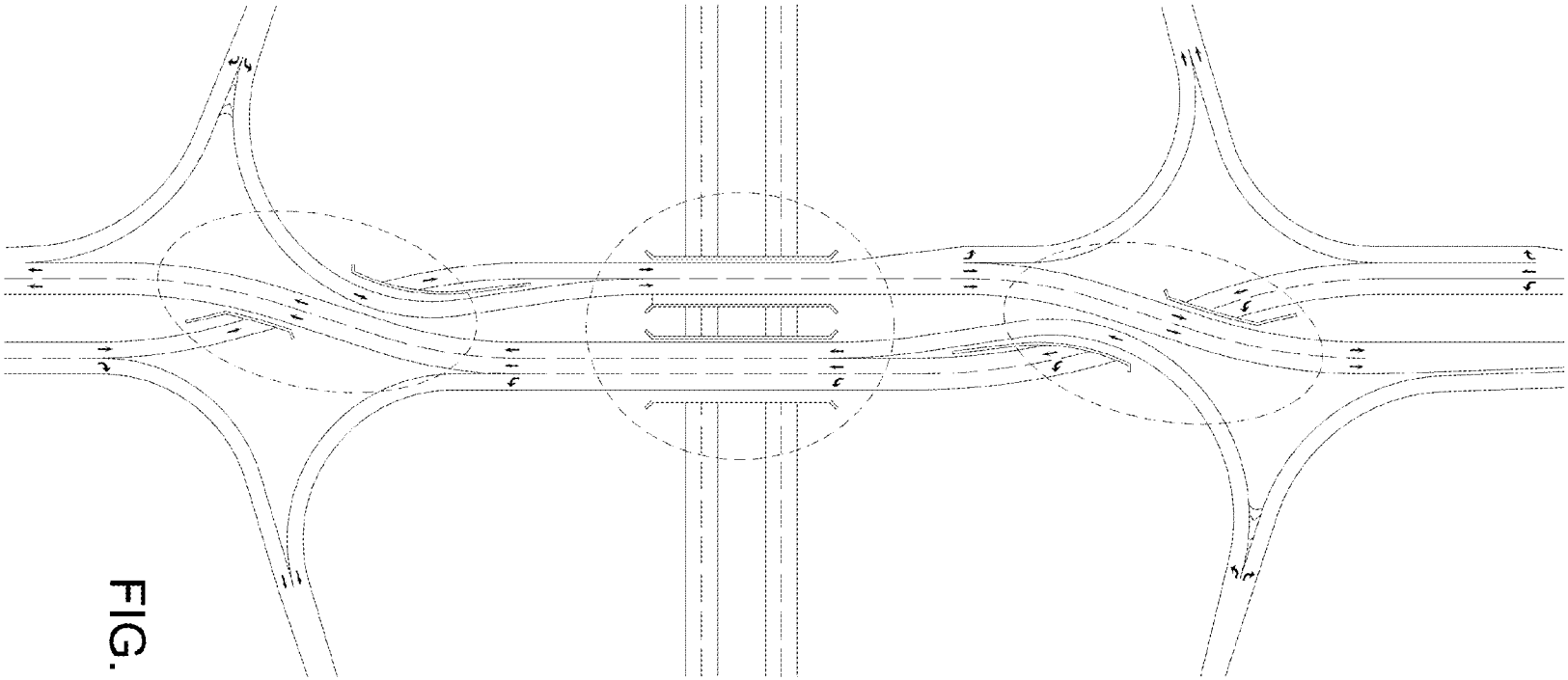
FIG. 18 is an illustration of a preferred embodiment of the disclosure showing minor side-bridges on either side of a main bridge.
Figure 19:
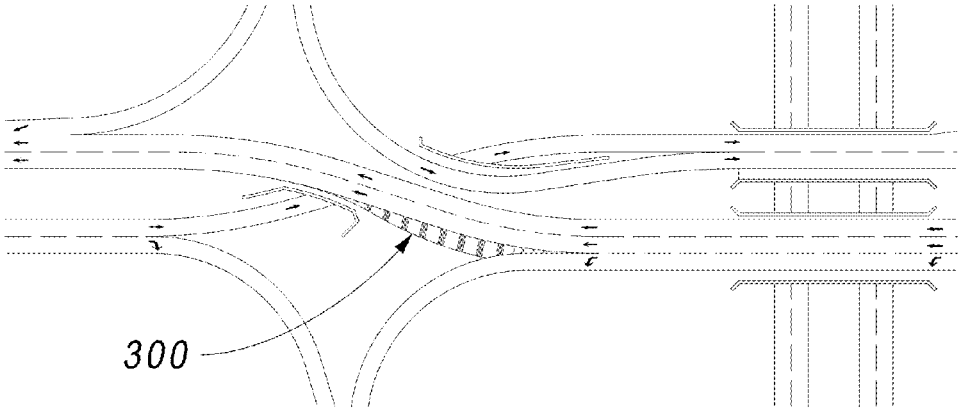
FIG. 19 is an illustration of a preferred embodiment of the disclosure being further provided with an escape lane.

FIG. 17, as discussed earlier, offers an alternative embodiment to the interchange. FIG. 18 illustrates lane movement and directional flow. FIG. 19 show the provision of an escape lane 300 permitting a space for errant drivers to place their vehicles should merging or lane-changing fail to be executed as desired.

FIGS. 20 through 23 generally illustrate lane continuity considerations to be taken into account in any interchange design. Given the unique characteristics of the DCMI, developing the optimal lane configuration can be challenging. Since both the crossroads have free-flow traffic operations, the ability to provide standard route continuity seems logical. However, by its nature, the DCMI requires some of the traffic operations to occur on the left, as opposed to the right side of a highway. INTERCHANGES DESIGN, Chapter 1360, Route Continuity, WSDOT Design Manual, M 22-01.05, June 2009. This results in the need to consider two primary methods to achieve an optimal lane configuration for any given location, lane continuity and turning movement and distribution.

The AASHTO (American Association of State Highway & Transportation Officials) Green Book describes this as providing a route in which changing lanes is not necessary to continue on the through route. Guidance for route or lane continuity in typical interchanges is well documented in the AASHTO Green Book. However, strategies for providing appropriate route continuity are less defined for complex interchanges. DESIGNING COMPLEX INTERCHANGES, Mark Doctor, George Merritt, and Steve Moler, FHWA-HRT-10-001, Vol. 73, No. 3, November/December 2009.

This is also the case with unique or alternative interchange configurations. FIG. 13 illustrates an embodiment of the disclosure that provides a DCMI having lane continuity for the through movement on the minor road. Note this type of lane configuration provides lane continuity, but adversely it produces merging and diverging sections on or near the main bridge in between the minor side bridges, resulting in more turbulence between traffic streams. The merging section can be moved further away from the bridge, or the traffic can be carried on a full lane until it is outside the direct influence of the interchange. Although moving merging sections further away from the interchange, or carrying full lanes past the interchange, may improve operations, it can result in an increase of required right-of-way and/or lanes as well, leading to higher construction costs. Accordingly, the benefit of providing lane continuity versus additional construction cost needs to be evaluated to determine if the benefits over time will outweigh the initial construction costs.

The other consideration in developing an optimal lane configuration is turning movement and distribution. Developing the lane configuration based on the turning movements and traffic volumes distribution usually produces a configuration with a smaller cross-section. This allows for reduced costs, especially in the area of bridge construction. This type of analysis approach also places focus on balancing traffic volumes in each lane within adjacent lanes as they move through the interchange. Balancing traffic volumes in adjacent lanes should not be confused with the term "Lane Balance," which refers to the number of approach lanes on a highway in relation to the number of lanes beyond a highway exit. Balancing traffic volumes in adjacent lanes aims to distribute the number of vehicles in a manner that maximizes the utilization of a lanes capacity, while minimizing the number and length of required lanes. The traffic volumes in each lane are also a consideration when using the lane continuity method. In that procedure, the lane continuity is the primary objective, and capacity needs are addressed by adding additional auxiliary lanes. FIGS. 15 and 16 illustrate adapting this approach to the current disclosure.

Although this can produce an efficient lane configuration, often with a smaller footprint and elimination for additional auxiliary lanes due to the required crossovers and merging sections of the DCMI, it may not provide the ability for through-movement without requiring some of the vehicles to change lanes prior to entering the interchange. Moving the vehicles into the proper lane prior to entering the influence of the interchange is vital to achieve efficient operations. This can be accomplished through effective signing, preferably overhead.

FIG. 14 illustrates a DCMI lane configuration configured to address turning movement and traffic distribution considerations. Note if this type of lane configuration is employed, escape lanes can be used to provide an emergency refuge for drivers that may be in the wrong lane. The escape lane can be paint markings, although mountable rumble medians have more visible lane guidance as well as the ability to deter non-essential use of the escape lane. FIG. 19 illustrates how an escape lane can be incorporated in a lane configuration that does not explicitly provide lane continuity. An example of escape lane placement is illustrated in FIG. 19.

The benefit of lane continuity must be balanced with the increased cost associated with providing additional lanes and required bridge structure. In some instances where a turning movement and distribution focus is applied and lane continuity is not the primary focus, a directed lane change may be needed. There are several situations where directed lane changes are implemented routinely.

Figure 20:
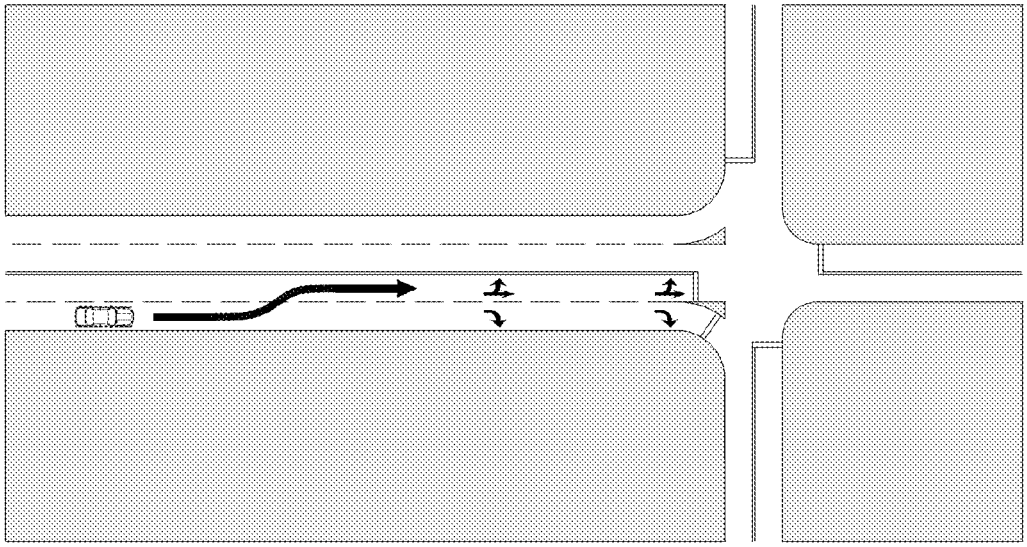
FIG. 20 is an illustration of the right-lane of a two-lane approach becoming an exclusive right-turn lane.
Figure 21:
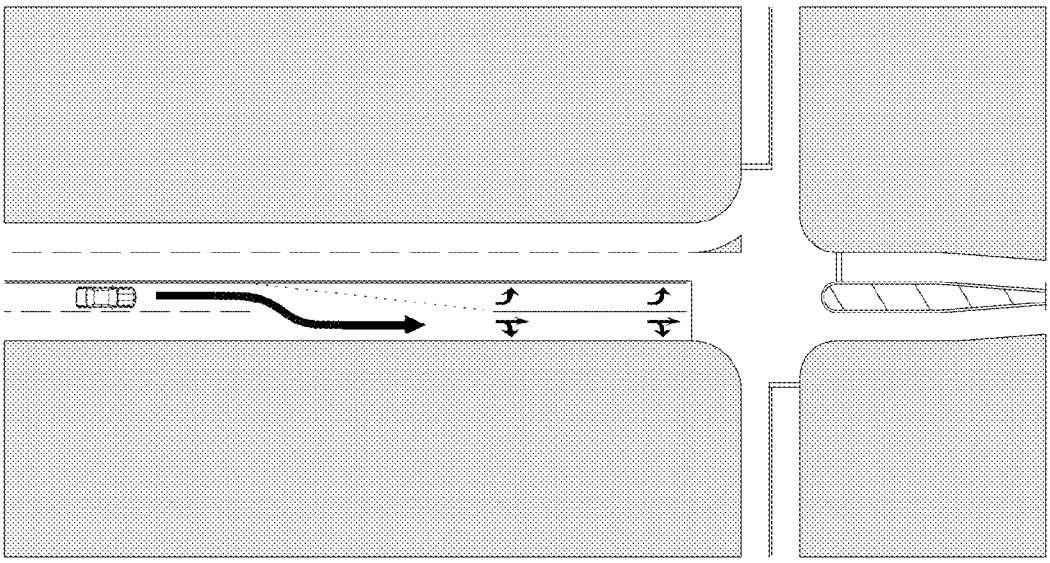
FIG. 21 is an illustration of the left-lane of a two-lane approach becoming an exclusive left-turn lane.

To better understand how a driver may interpret a directed lane change at a DCMI, reference is made to the following, commonly-used configurations. Often, a two-lane cross-section will change to a four-lane cross-section; this transition usually occurs at an intersection. When this occurs, the driver may need to change lanes to execute a through movement, as lane continuity is not assured. FIG. 20 illustrates the right-lane of a two-lane approach becoming an exclusive right-turn lane. In this example, the driver must change into the left lane to perform a through movement. Conversely, in FIG. 21, the left lane of a two-lane approach transitions to a left-turn-only lane. In this example, the driver must change lanes into the right lane to perform a through movement.

Often, a two-lane cross-section that transitions into a four-lane cross-section at an intersection is constructed with the intention of continued expansion of the two-lane cross-section to a four-lane cross-section in the future. In practice, however, the two-lane cross-sections often stay in place for years or never change to a four-lane cross-section.

Figure 22:
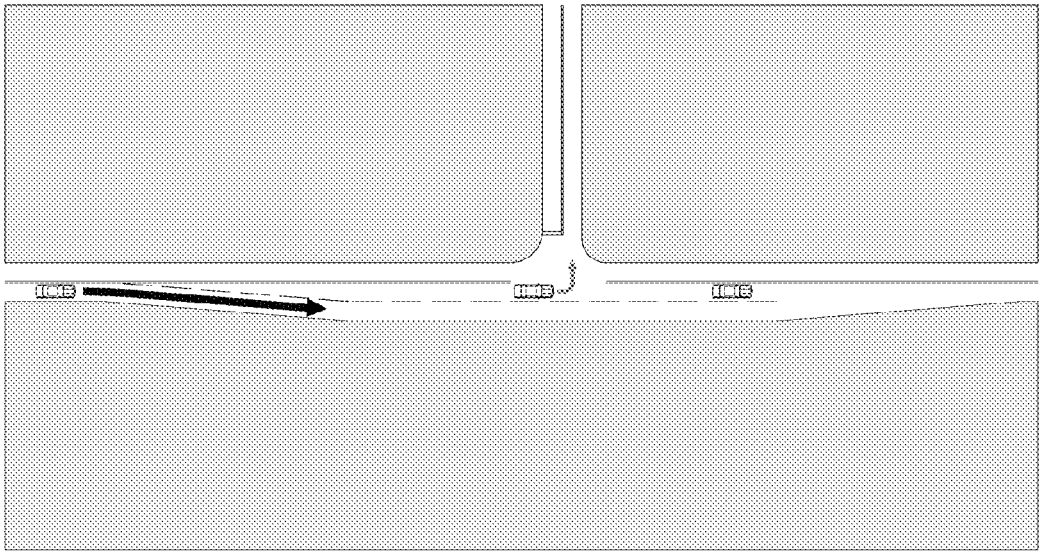
FIG. 22 is an illustration of an auxiliary or passing-lane configuration.
Figure 23:
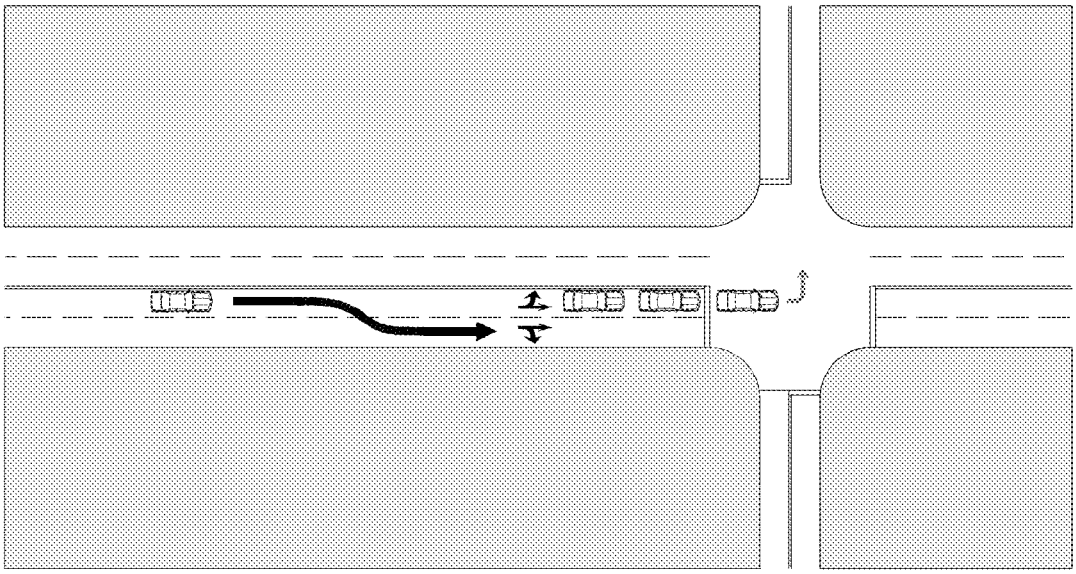
FIG. 23 is an illustration of an Alternative configuration of a passing-lane configuration.

Other directed lane change configurations or lane change behaviors that are similar can be observed in FIG. 22 and FIG. 23. FIG. 22 illustrates a rural auxiliary/passing-lane geometric configuration. In this case, a one-lane approach is flared to two lanes to allow vehicles to pass slower moving vehicles. This often occurs at a location with a T-crossroad, and allows the inside lane to serve as a left turn lane as well as an auxiliary lane. Although a vehicle can stay in the inside lane to perform a through movement, the pavement marking typical directs the vehicles to the outside lane. FIG. 23 illustrates a configuration that elicits similar behavior to directed lane changes, although it is not explicitly marked to require the inside lane occupant to change lanes to continue straight ahead. Common urban intersection may not have a left turn lane; consequently, the inner lane serves as either a through or left-turn lane. This may queue traffic in the inner lane, forcing drivers to change into the outer lane to perform a through movement during heavier traffic flow. This results in a consistent driver behavior similar to that of a directed lane change. As seen in FIGS. 20 through 23, there are many situations that do not provide lane continuity and operate satisfactorily under heavier traffic conditions. While lane continuity is promoted as ideal, the decision to provide lane continuity at any intersection must be carefully evaluated in view of costs.

Figure 24:
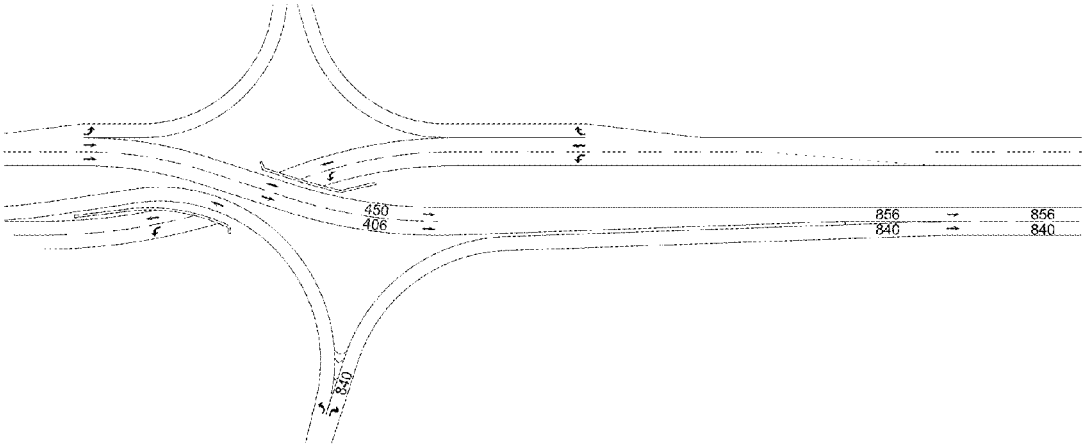
FIG. 24 is an illustration of lane volume balance considerations in selecting a preferred interchange.

Lane volume balance is not only a consideration on the approach to the interchange, but also should be a consideration as vehicles exit the interchange. FIG. 24 provides an example of balanced traffic volumes as traffic exiting the DCMI is merged from two lanes down to one lane, and the relatively heavy northbound right turn from the off-ramp becomes an exclusive second lane. As can be seen in the figure, this creates a relatively equal number of vehicles in each lane as traffic proceeds away from the interchange.

Ultimately, the optimal DCMI lane configuration may be a combination of the lane continuity and turning movements, as well as the traffic volume distribution methods. The preferred lane configuration is usually based on the need to achieve balance among competing objects such as safety, capacity, available right-of-way, local access needs, and construction cost. Traffic volumes in each lane are also a consideration when using the lane continuity method, but in that procedure, the lane continuity is the primary objective, and capacity needs are addressed by adding additional auxiliary lanes.

Applying therefore an operational analysis, the capacity analysis for the DCMI should consider several determining factors: (1) lane capacity, based on the capacity of a single lane as determined by local saturation limits; (2) merging sections in view of maximum merging capacity operations and (3) the effect of pedestrians and bicyclists on traffic flow and safety.

The capacity of an individual lane can vary depending on geographic location. Lane capacity should be based on observed local saturation limits. This maximum lane capacity will serve as the basis for the capacity analysis. Additionally, the merging operations may have a secondary effect on capacity and operations. The lower of the two limits should be used to determine the capacity of each part of the interchange. To determine the predicted operations of the merging sections, two methods can be applied. The Highway Capacity Manual (Transportation Research Board, Highway Capacity Manual, Chapter 13, Freeway Merge and Diverge Segments, 2010, ISBN 978-0-309-16077-3) prescribes formulas for calculating capacity at merging sections; however, these are typical for higher speed merges on freeways. The HCM formulas can be applied, but may produce a more conservative estimation, therefore underestimating optimal maximum capacity of the merging sections. Depending on the design methods applied, the speeds may be substantially lower than on a typical freeway section. Another method includes the use of a micro-simulation model to assess the capacity of the merging sections. This method is typically more time consuming, but may more accurately reflect a merging section with lower speeds then that of a freeway section with higher speeds.

Based on traffic turning movements and volumes (typically for a projected design year) and the local lane saturation volumes, a lane configuration can be developed. The preferred lane configuration will allow vehicles to travel through the interchange without having to change lanes once on the interchange. Minimizing the number of merging sections can also enhance operations. FIGS. 15 and 16 show the distribution of predicted traffic volumes in each lane as the vehicles pass through the DCMI interchange.

As an example, some resulting characteristics of a lane configuration based on turning movements and distribution are shown in FIGS. 14 through 16. The north section of the main bridge only required two lanes, while the south section of the main bridge requires three lanes to accommodate the example projected design year volumes. As configured, no weaving or merging sections appear within the interchange itself. Any vehicles needing to change lanes are guided to do so prior to entering the interchange. All merging sections occur as vehicles leave the interchange, not while they are still in it. Due to the higher right turn volumes on the eastbound approach to the interchange, only one lane is used under the minor bridge on the west side, while two lanes are used on the minor bridge on the eastside. The northbound off-ramp has a relatively larger number of vehicles turning right. By merging the eastbound minor road traffic down to one lane as it exits the DCMI, a relatively even distribution of traffic can be achieved (FIGS. 24, 15, 16). As can be further seen in FIG. 14, this lane configuration allows vehicles to travel though the DCMI without having to change lanes in the interchange, and only requires merging as the vehicles leave the interchange.

Additional Features Available to the Disclosure

Figure 25:
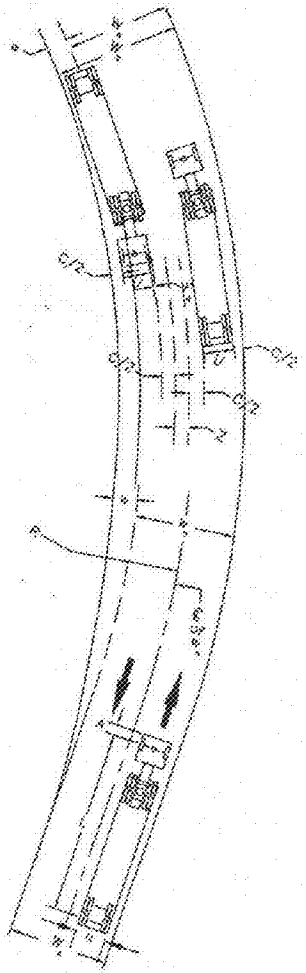
FIG. 25 is an illustration of widening components on open highway curves.

Referring now to FIG. 25, another consideration in the interchange design is the design speed and the curvature of the roadway. To allow the minor roadway's bi-directional traffic to crossover each other via the two minor side bridges, the roadway requires a certain amount of horizontal curvature. Given that one of the primary benefits of the DCMI is the capability of providing free-flow operations within a relatively small footprint, as with the vertical curvature, it is conducive to locate the minor side bridges in close proximity to the main bridge. However, the closer the minor side bridges are to the main bridge, the smaller the crossover radii becomes, which can result in remarkably slower speeds as compared to the approach speeds to the interchange. The slower speeds are beneficial for safety and operations of the DCMI, but it needs to be balanced by using appropriate radii, as too small of a radius can hinder safety and operations. The smaller the crossover radii become, the wider the roadway width needs to be to accommodate longer design vehicles such as WB-65 trucks and other such vehicles (even a standard tractor trailer pulls a 53-foot trailer).

The roadway curvature can be designed to control and reduce speeds through the minor roadway of the interchange to enhance operations and safety. This offers more time for drivers to identify, interpret, and navigate the interchange, as well as increases the capacity and safety of the merging sections. The design speed of the crossover radii should result in a reasonable reduction of speed from the posted upstream approach speed, while realizing accord with vertical and horizontal design parameters. Providing independent main bridges for each direction of traffic flow also allows design flexibility for the horizontal crossover curves of the minor side-bridges. See, e.g., FIG. 25, an excerpt from the AASHTO Green Book that illustrates roadway widening that may be adapted to the herein disclosed minor side bridges of a DCMI. American Association of State Highway and Transportation Officials (AASHTO), Geometric Design of Highways ad Streets, Chapter 3—Elements of Design, Traveled Way Widening on Horizontal Curves, 2004.

Figure 26:
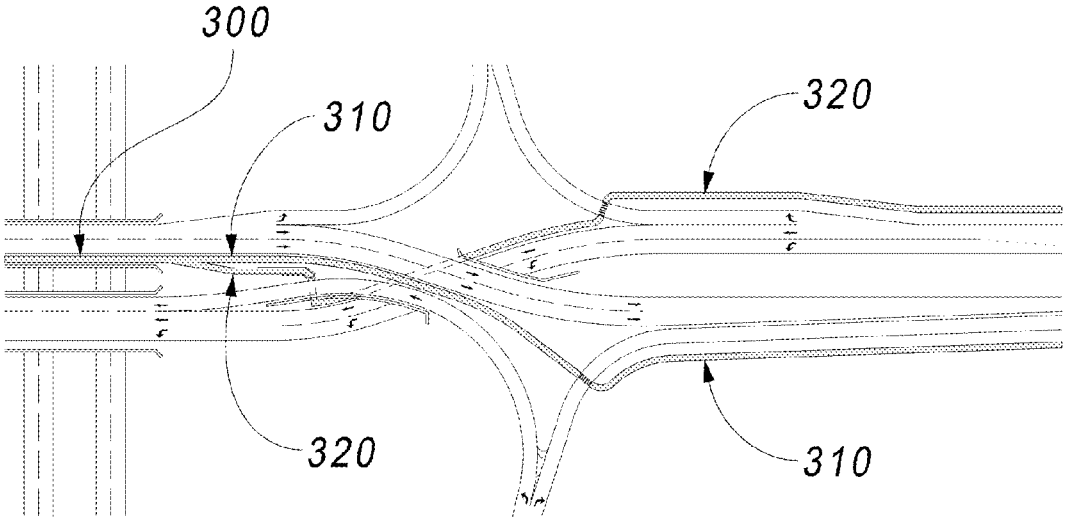
FIG. 26 is an illustration of a preferred embodiment of the disclosure providing a cross-over for non-motorized users.
Figure 27:
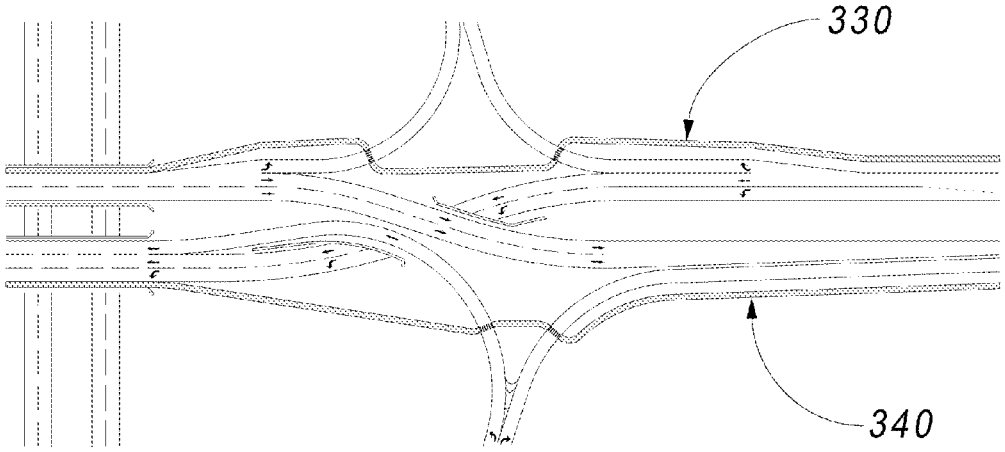
FIG. 27 is an illustration of a preferred embodiment of the disclosure providing parallel accommodations for non-motorized users.

Referring now to FIGS. 26 and 27, still a further consideration for implementing the disclosed DCMI is that of non-motorized traffic, such as pedestrians and bicyclists. Disclosed are two primary configurations to accommodate pedestrians and bicyclist at a DCMI.

At FIG. 26, the first uses the two minor side bridges and crosses the walkways or paths over one another in a similar manner as the roadways. Thus, as viewed from left to right, sidewalk 300 splits into two sidewalks 310, 320. Sidewalk 310 continues adjacent the roadway going over the minor crossover, eventually moving on to cross over (or at grade) an exit lane and to the right of FIG. 26. Sidewalk 320 crosses under an entrance lane and under the minor crossover, crossing over (or at grade) an exit lane and to the right of FIG. 26.

In FIG. 27, at grade intersections of the crosswalks 330, 340 with respective exit and entrance lanes is shown. To maximize safety, the crosswalks 330, 340 each intersect any exit and entrance lanes substantially perpendicularly, thereby shortening their distance and maximizing a pedestrian's ability to see motorized traffic of concern. Thus, the second provides walkways parallel to the minor roadways in a contiguous manner.

The parallel configuration (FIG. 27) accommodates pedestrians and bicyclists via walkways on the outside of the minor roadway. This eliminates the need and expense of the additional structural components needed to cross the pedestrians and bicyclist under at the minor side-bridges, and consequently results in a lower associated cost. Conversely, the parallel configuration introduces an additional conflict area at the on-ramp/off-ramp pedestrian crossing, as both the left-turn and right-turn to the on-ramps/off-ramps are crossed at-grade.

FIGS. 26 and 27 illustrate the parallel pedestrian and bicyclist accommodations. As with the crossover configuration, the parallel configuration can either be signalized or un-signalized, and can be designed to only activate when there is a demand. Speed control and visibility should also be addressed in the parallel configuration. In addition to introducing the extra conflict area, the parallel configuration does not provide the ability for user to change sides of the minor roadway.

In many instances the at-grade pedestrian/bicyclist crossing will suffice. If desired, pedestrian crossing bridges or underpasses can be provided at the turns to the on/off-ramps in order to totally eliminate pedestrian-bicyclist interaction with vehicular traffic. However, this would increase the cost. Assessment of pedestrian volumes and needs should be evaluated to determine benefit to cost ratios for pedestrian bridges or underpasses at the turn lanes to the on/off-ramps. If visually impaired pedestrians are identified in the area, they could be accommodated using crossing solutions for channelized turn lanes. NCHRP 674, Crossing Solutions at Roundabouts and Channelized Turn Lanes for Pedestrians with Vision Disabilities, National Cooperative Highway Research Program, 2011.

Another advantage of the DCMI is its ability to offer a continuously flowing interchange within less right-of-way and subsequent cost than a standard full interchange with the same capabilities. Full Interchanges, such as a cloverleaf (FIG. 5), usually required larger ramp radii and outer right-turn bypass lanes, which typically require a large footprint. Other interchange options that are commonly favored over the cloverleaf often utilize flyovers (FIG. 3). The flyovers can dramatically increase the cost, and use large radii to accommodate the higher design speed. These also require a larger footprint in addition to increase cost. The DCMI permits ramps to parallel the main highway upon exiting and permits a smaller footprint, more akin to that of a typical at-grade signal controlled interchange (FIG. 4).

Typically, free-flow interchanges do not provide for local access within the vicinity of the interchange. In contrast to this standard, the DCMI can be configured to provide full local access within close proximity of the interchange. This is partially because of the reduced speed of traffic on the minor roadway. One preferred configuration for providing local access while maintaining free flowing traffic is the use of median U-turns in conjunction with the DCMI. The use of median U-turns provides enhanced safety for the left turns. It also moves the left turn further away from the interchange while allowing the access drives to be located closer to the interchange.

Figure 28:
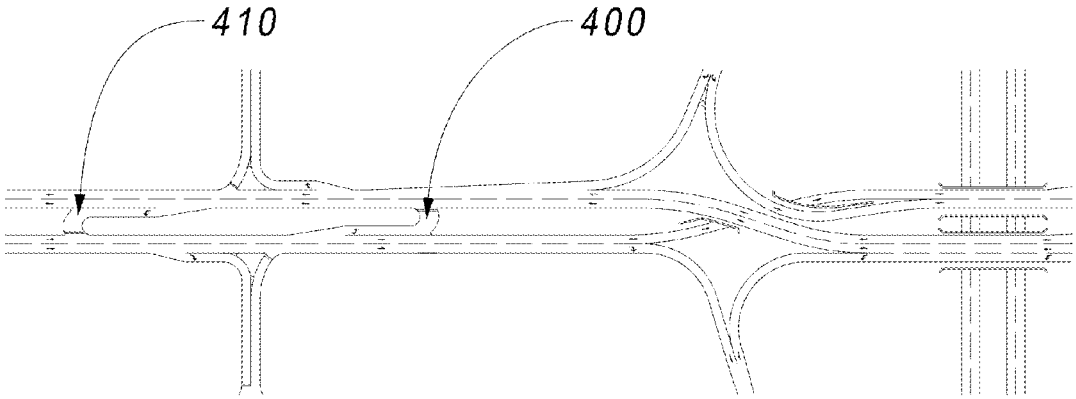
FIG. 28 is an illustration of a preferred embodiment of the disclosure providing local access to the minor path.

Referring now to FIG. 28, providing U-turns 400, 410 can facilitate access to a local, very minor road at minimal expense, provided the U-turns are located sensibly given the other demands on the interchange. Although the median U-turn requires a larger median to accommodate the U-turn, the DCMI's crossover radii create a wider median on the approach to the interchange. This wider median can be extended to provide for the median U-turn. Standard permissive left turns could be implemented, but they generally have a lower level of safety and require the left turn to occur closer to the interchange and crossover radii. FIG. 28 illustrates the use of median U-turns with the DCMI to provide full access while maintaining free-flow traffic operations. In addition to the median U-turns, the use of right-in/right-out access drives along the on-ramps and off-ramps can provide additional flexibility to develop an enriched local access scheme. In certain situations, the use of the right-in/right-out access drive may also be used to reduce required lane changes within the influence of the interchange. Ideally, the median U-turns would be stop controlled. If the left turn volumes are higher, or if there are insufficient gaps available to the left turning vehicles, signalization at the median U-turn may need to be considered. In this situation, a two-phase timing scheme can be applied in lieu of stop control. This provides greater flexibility for the timing scheme development, as each of the median U-turns can run independently of each other. For example, the westbound minor roadway traffic can continue to flow, even when the eastbound minor roadway traffic is stopped (red light) to allow median U-turn vehicles to enter onto the eastbound minor roadway. The two-phase signal at the DCMI median U-turn is different from the two-phase signal of the at-grade signalized DCI (Diverging Diamond), as the through movements on the minor roadway never cross, only the left turns and one direction of traffic conflict at the median U-turn. This can result is substantially less conflict and reduced delay. Combinations of the median U-turn(s) or right-in/ right-out(s) can be utilized to optimize the local access scheme.

Because of the unique nature of the crossover method used in the DCMI, and the fact that using the crossover scenario is not yet common practice, a way-finding system is important to an error free response from drivers. The preferred signing scheme used depends in part on how the lane configuration was developed, e.g., using lane continuity or turning movements and traffic distribution. Overhead signing is preferable (or at least partial overhead signing) for atypical movements or movements that require vehicles to change lanes prior to entering the DCMI.

Figure 30:
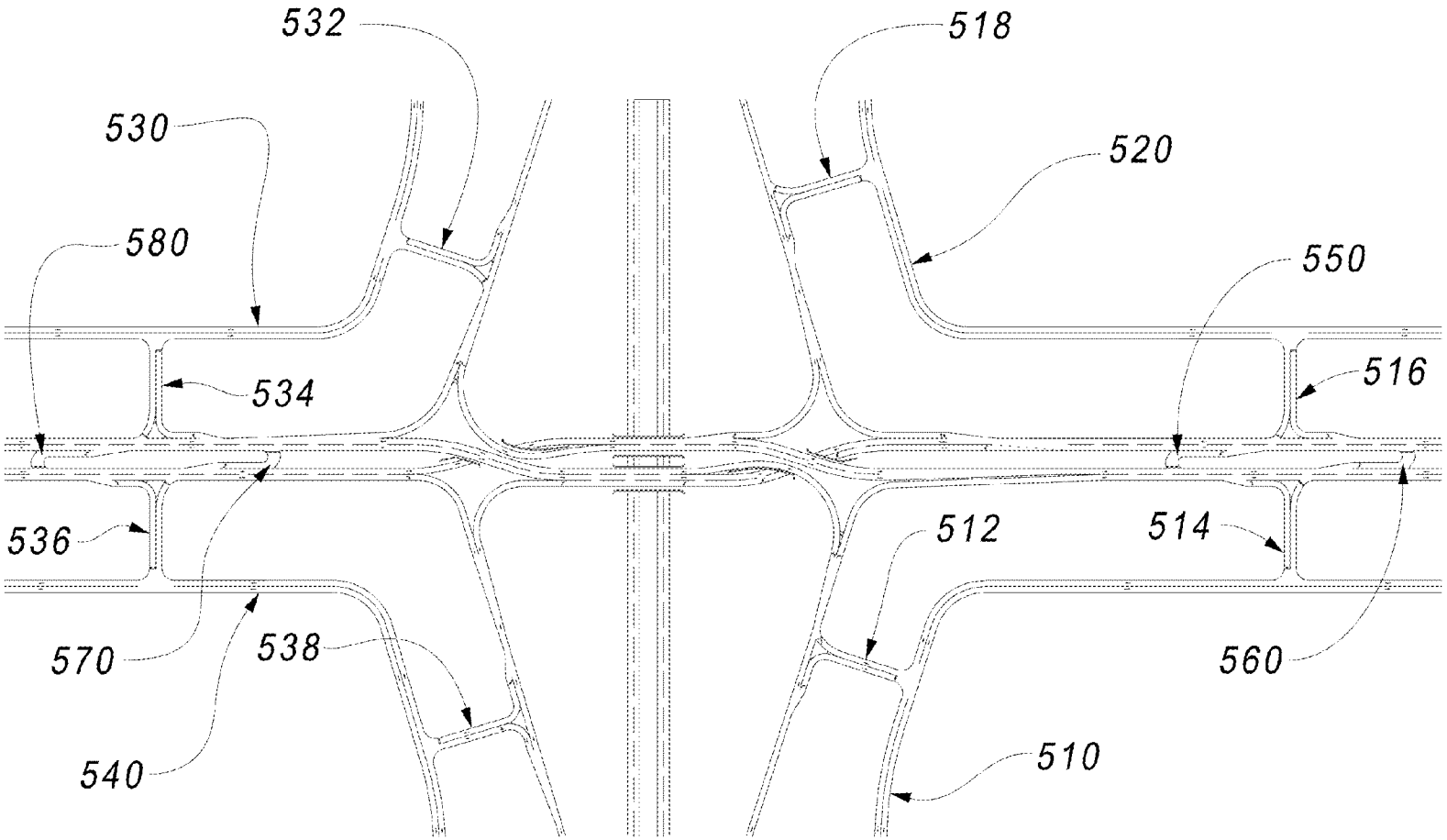
FIG. 30 is an illustration of a preferred embodiment of the disclosure providing another local access configuration.

The implementation of local access near the DCMI can complicate the way-finding task and required signing. Although the use of right-in/ right-out access drives on the on-ramps/ off-ramps can enhance access, it can also provide two points of access to a destination, which can further complicate the way-finding and may encourage lane changes within the interchange if the signing is not clear and concise. For example, FIG. 30 illustrates an embodiment in which local access is provided to four area roads 510, 520, 530, 540 passing near the interchange, such as access roads. In this ladder-type application, access to the exit and entrance lanes of the interchange is provided via access roads 512, 514, 516, 518 and 532, 534, 536, 538. U-turn lanes can be provided on the secondary pathway as shown at 550, 560, 570 and 580.

In more complex DCMI configurations, especially where local access is needed, the use of a color-coded way-finding scheme may be beneficial. A color coded way-finding scheme may be, similar to the type of system used in hospital halls for navigating through the building to different destinations. However, in most instances, the use of a color coded system would deviate from common practice, and may require some type of application to deviate from it. Moreover, in locations in which snow cover is problematic, the utility of such a solution would be compromised.

Figure 29:
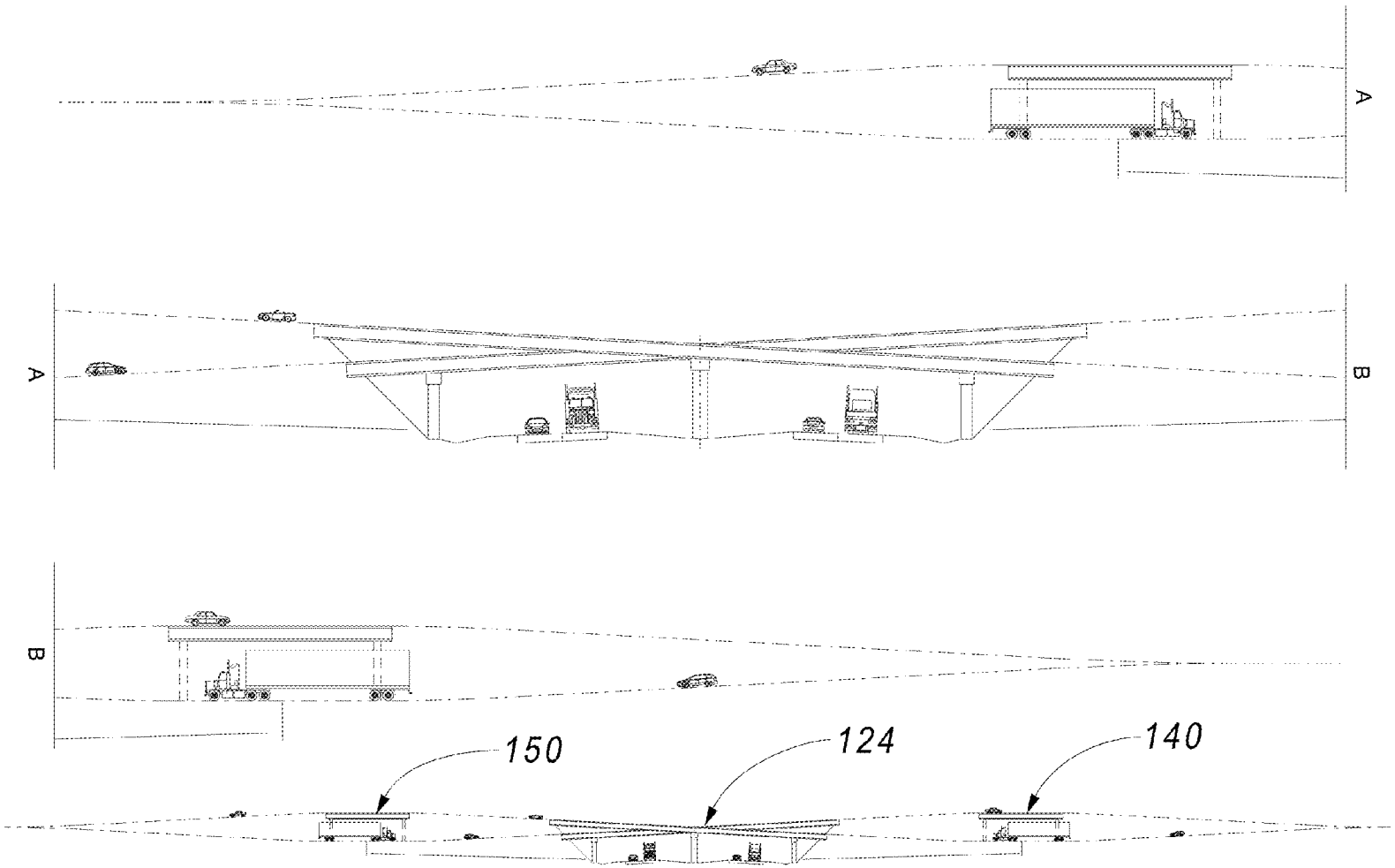
FIG. 29 is an illustration of a preferred embodiment of the disclosure illustrating a profile and gravity drainage system.

Referring now to FIG. 29, one factor of ramp alignments, and consequently the area requirements of the DCMI interchange, is the grade separation requirements for the minor side bridges. This results in a slightly larger distance and subsequent alignment for the main bridge. Nonetheless, even with the additional distance of the ramp alignment from the main bridge, the area requirements are still substantially less than other interchange options that allow free flowing traffic, e.g. traditional full cloverleaves or fly-over interchanges.

As shown generally in FIG. 29, to implement the minor bridges on either side of the major bridge, grade and profile considerations must be accommodated. Several grade changes are required to the roadway profile. This can have a determining effect on both the distance needed from the main bridge 124 to each of the minor side bridges 140, 150 as well as the resulting percentage grade change. Acceptable grade change ranges vary depending on geographic location and jurisdictional requirements. Typical grade change ranges for this type of an application are between 4% and 6%. The preferred configuration will provide a natural gravity drainage system for the low points of the minor bridges. Utilizing this type of gravity drainage systems eliminates the need for pumps at the low points under the minor side bridges.

To minimize the space requirements for a DCMI, the minor side bridges 140, 150 are located as close to the main bridge 124 as practicable. However, the minor side bridges 140, 150 must be positioned far enough from the main bridge 124 to allow the required grade changes to accommodate semi-trucks under the minor side bridges 140, 150. The preferred embodiment provides the required grade change evenly between the bi-directional traffic of the minor road, with approximately half the required grade change applied to the roadway going over the side bridge, and the other approximately half of the required grade change applied to the roadway going under the side bridge. This allows each direction to experience as much as half of the needed grade change, as opposed to the whole grade change in one direction, which would result in twice the distance requirement to allow tractor trailers to pass under the minor side bridges. (Lesser even splits could be accommodated, as well, e.g. ⅓-⅔, as necessary to achieve the objectives of the consideration.)

To further reduce the distance between the main bridge and the minor side bridges, the main bridge decks can preferably be sloped. By using two separate main bridge sections with opposing slopes, part of the required grade change between the main bridge and the minor side bridges can be achieved. This provides a substantial amount of the needed grade change prior to vehicles leaving the bridge deck. For example, a 200 foot long bridge deck, with a 3% slope in each direction, would provide 6 feet of the needed grade change. FIG. 29 illustrates how the vertical profile of the sloped main bridge in conjunction with the two minor side bridges could be developed.

Although previous versions of diverging interchanges have used a combination of minor-side bridges to cross-traffic (diverge), these configurations have crossed two streams of traffic, usually bi-directional traffic from one roadway, crossing it over before the main bridge, and then returning the traffic streams to the original sides after the main bridge.

Figure 31:
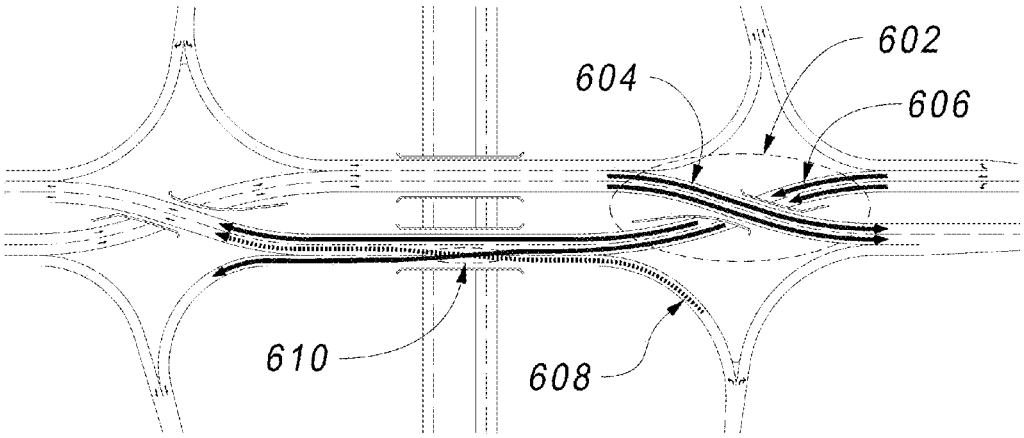
FIG. 31 is an illustration of a preferred embodiment of the disclosure illustrating lane weaving considerations.

As seen in FIG. 31, just crossing the bi-directional traffic steams 604, 606 over a side bridge 602 in a diverging interchange configuration does not provide an adequate solution, as a third traffic stream, in this instance the left turning off-ramp traffic 608, results in a weaving section. The resulting weaving section degrades the operations of the interchange by reducing capacity and safety.

As illustrated by FIG. 10, in the interchange 70 only the bi-directional traffic (two traffic streams) is crossed-over on the side-bridges. In FIG. 11, the interchange 80 only crosses the bi-direction traffic (two traffic streams) over the side-bridges. The DCMI offers a unique solution to eliminate the weaving sections of the diverging interchange.

Figure 32:
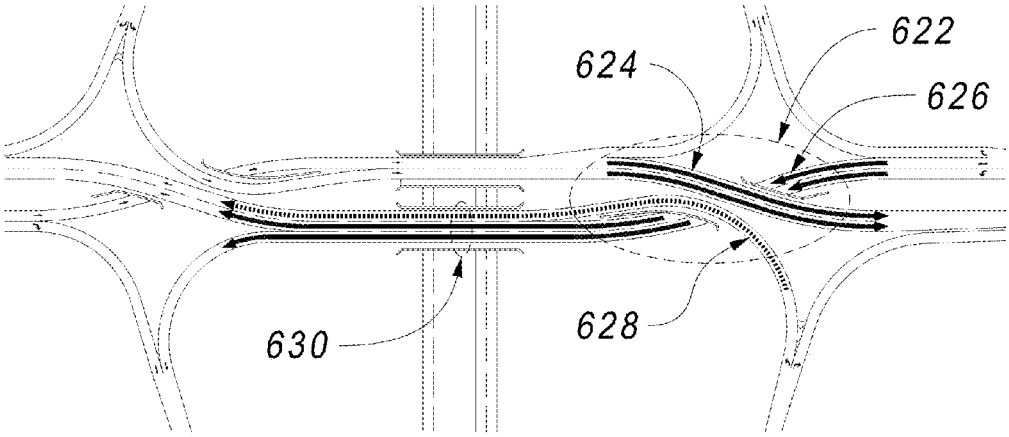
FIG. 32 is another illustration of a preferred embodiment of the disclosure illustrating lane weaving considerations.

Looking now to FIG. 32, the DCMI crosses the bi-directional traffic 624, 626 over the side bridge 622; however, the third traffic stream 628 (in this instance, the left turning off-ramp traffic) is reconfigured to swing up, and utilizes the same minor side bridge 622 as the bi-directional traffic streams 624, 626. This configuration eliminates the weaving 630 and results in the ability to construct the DCMI in a small footprint, with free-flow operations and no weaving sections. Moreover, the combination of the three traffic streams 624, 626, 628 using one side bridge 622 negates the need for loops ramps, and a wider bridge due to the additional lane needed to pass traffic over the main bridge to the loop ramps, as required by the interchange 80 of FIG. 11.

Thus, the DCMI requires the use of two minor side bridges on either side of the main bridge, which increases construction costs. Even so, it may still be less expensive and provide a higher level of benefit than other options that provide free-flow operations. In situations where a free flowing traffic interchange is desirable, the DCMI can provide a less expensive alternative than schemes where fly-overs are required, or situations where extensive land acquisition for full interchange configurations are needed. An additional DCMI operational benefit that should be considered is the possible elimination of short weaving section, such as experienced in a full cloverleaf interchange configuration.

The simplest and most common cost-benefit analysis compares the cost of construction to the anticipated level of service, or more precisely, the anticipated average delay. While this type of analysis provides a fundamental comparison, a more comprehensive cost-benefit analysis may include other pertinent factors.

Components included in a more comprehensive cost-benefit analysis include (1) the level of service or delay; (2) the safety performance; (3) right-of-way acquisition difficulty and cost; (4) vehicle emissions; (5) aesthetics; (6) noise abatement and (7) fuel consumption.

The level of service component typically does not have a direct cost associated with it. Moreover, it usually serves as a benchmark for the anticipated operations. When comparing it with other options, however, a cost can be associated with the additional delay anticipated above and beyond the benchmark delay. This cost is usually computed by seconds of additional delay and is derived from a cost to society. As society continues to favor safer and more sustainable roads, roadway systems that offer a higher level of safety are increasingly favored.

The DCMI removes the weaving sections from an interchange and results in lower speed merging sections, which typically provides a higher level of safety. Subsequently, the cost to society for collisions may be greatly reduced. As with safety, society has begun to focus on sustainability in transportation systems. Some of the sustainability components that can directly be incorporated into a cost-benefit analysis include vehicle emission reduction and fuel consumption. Intersections/interchanges that provide free flowing traffic can result in reduced vehicle emissions, reduced fuel consumption, and reduced noise pollution, as vehicles do not need to stop, idle, and then start again. Aesthetics and noise abatement are usually categorized in a more qualitative fashion, and their respective benefits may be harder to quantify, but they still warrant consideration.

By implementing the unique crossover configuration of two minor side bridges on either side of a main bridge, the DCMI can provide a new type of interchange/intersection providing free flow traffic operations within area requirements similar to a diamond interchange configuration. The two minor side bridges allow the through traffic movements on the minor road to temporally cross over each other. This also allows the left turning traffic from the off-ramps to cross-over the minor street traffic and become a merging movement, as opposed to a weaving movement, thereby providing safer and more efficient traffic operations. The DCMI provides the benefit of free-flow traffic operations and offers a new and unique interchange/intersection configuration that reduces or eliminates the need for traffic to weave. In addition, the DCMI encourages slower, more efficient and safer merging operations along the minor street, or where traffic would typically need to cross conflicting traffic. In situations where there is a need to provide an interchange/intersection with free flowing traffic characteristics, the DCMI can offer many advantages in lieu of typical full interchange options, or interchanges with fly-over roadways.

The analysis and design of the lane configuration is critical in assuring error free operations. Determining the optimal lane configuration requires careful consideration, including the assessment of lane continuity, turning movements, lane balance and distribution. The optimal lane configuration should be developed based on site-specific characteristics and goals. Ultimately the preferred lane configuration may be a combination of lane continuity, turning movements, lane balance and distribution, and their competing objectives. Even if a DCMI does not provide explicit lane continuity, if there is a sufficient advanced signing system, the DCMI can operate without lane changes, weaving, or merging between the two minor side-bridges; hence, the operations between the two minor side-bridges can be simplified while reducing the number of lanes and bridge construction cost.

Although the DCMI functions like a full interchange, allowing free-flowing traffic, it has characteristics of both an interchange and a standard at-grade signalized intersection. As such, this requires the designer to be critical in considering how the driver may interpret, and subsequently react to the DCMI's lane configuration, geometric body language, and way-finder system.

The DCMI can be designed and constructed to accommodate all non-motorized users, including pedestrians and bicyclists. If visually impaired pedestrians are identified in the area, they could be accommodated using crossing solutions for channelized turn lanes. Vertical and horizontal grade and profile issues can be addressed and developed to operate within acceptable ranges while still allowing for a smaller diamond type interchange, moreover, without the need for costly fly-over or full size interchange configurations such as a cloverleaf. If required, a local access system can be provided while still maintaining free-flow operations.

The DCMI offers an innovative and efficient alternative to standard interchange design. In certain situations, the DCMI can allow free-flow operations, increase capacity and safety, reduce construction cost, and reduce right-of-way needed (as opposed to other free-flow alternatives). This is increasingly evident if social costs such as vehicle emissions fuel consumption, noise pollution, and safety are considered.

Although much of the advantage to the foregoing disclosure has been expressed as attaining a small footprint for the interchange in comparison with prior art designs, this is not the only advantage to the disclosure. For example, where real estate or footprint size is not of primary concern, it can be appreciated that the disclosure can also be adapted to larger footprints yielding higher design speeds. Clearly, balancing the interests of footprint size and design speed capability will yield an optimal result.

Although the preferred embodiment has four legs, a three leg version can be implemented, as well. The three leg version would still have two minor side-bridges; however, in a three leg version, one minor side bridge would have three streams of traffic, whereas the other side-bridge would only have two streams of traffic crossing it.

It is understood throughout this discussion that reference is given from the perspective of a right-hand drive system of highways, such as those in the United States and in most of the world. However, one having ordinary skill in the art of highway design will appreciate that the analysis can easily be modified to apply to a left-hand drive system, such as those found in England, Japan and elsewhere, by modifying the discussion accordingly.

The described embodiments are to be considered in all respects only as illustrative and not restrictive, and the scope of the invention is, therefore, indicated by the appended claims rather than by the foregoing description. Those of skill in the art will recognize changes, substitutions and other modifications that will nonetheless come within the scope of the invention and range of claims.

What is claimed is:

1. A crossover for travel paths comprising:

an interchange region defined by an interchange, boundary and having a major crossover subregion centrally disposed therein;

a primary travel path extending through the interchange region and through the major crossover subregion, the primary travel path having a first pathway arranged for travel in a first direction and a second pathway arranged for travel in a second direction, the first and second pathways arranged so as to not cross over one another throughout the interchange region;

a secondary travel path extending through the interchange region and passing sequentially through a first minor crossover subregion, the major crossover subregion and a second minor crossover subregion, each minor crossover subregion contained within the interchange region, the secondary travel path having a third pathway arranged for travel in a third direction and a fourth pathway arranged for travel in a fourth direction;

a main bridge crossover positioned in the main crossover subregion and constructed and arranged so that each of the first and second pathways cross under each of the third and fourth pathways without intersecting at grade;

a first minor bridge crossover positioned in the first minor crossover subregion, the crossover constructed and arranged so that the third and fourth pathways cross each other without intersecting at grade and further configured to receive a first exit-entrance communication lane;

a second minor bridge crossover positioned in the second minor crossover subregion, the crossover constructed and arranged so that the third and fourth pathways cross each other without intersecting at grade and further configured to receive a second exit-entrance communication lane;

each pathway having at least one lane, a first side and a second side and passing through the interchange boundary twice, thereby defining sequentially for each pathway a first pathway terminus and a second pathway terminus;

the first pathway having an exit path provided on the first side and positioned proximate to the first pathway first terminus;

the first pathway having an entrance path provided on the first side and positioned proximate to the first pathway second terminus;

the second pathway having an exit path provided on the first side and positioned proximate to the second pathway first terminus;

the second pathway having an entrance path provided on the first side and positioned proximate to the second pathway second terminus;

the third pathway haying a first exit path provided on the first side and positioned proximate to the third pathway first terminus;

the third pathway having, a first entrance path provided on the first side and positioned between the first minor crossover subregion and the major crossover subregion;

the third pathway having a second exit path provided on the second side and positioned between the major crossover subregion and the second minor crossover subregion;

the third pathway having a second entrance path provided on the first side and positioned proximate to the third pathway second terminus;

the fourth pathway having a first exit path provided on the first side and positioned proximate to the fourth pathway first terminus;

the fourth pathway having a first entrance path provided on the first side and positioned between the second minor crossover subregion and the major crossover subregion;

the fourth pathway having a second exit path provided on the second side and positioned between the major crossover subregion and the first minor crossover subregion;

the fourth pathway having a second entrance path provided on the first side and positioned proximate to the fourth pathway second terminus;

the first pathway exit path providing communication with the third pathway first entrance path; the first pathway exit path providing communication with the fourth pathway second entrance path;

the second pathway exit path providing communication with the fourth pathway first entrance path;

the second pathway exit path providing communication with the third pathway second entrance path;

the third pathway first exit path providing communication with the first pathway entrance path;

the third pathway second exit path providing communication with the second pathway entrance path;

the fourth pathway first exit path providing communication with the second pathway entrance path; and the fourth pathway second exit path providing communication with the first pathway entrance path;

the first exit-entrance communication lane constructed and arranged to pass over the first minor bridge crossover and communicate between the first pathway exit path and the third pathway entrance path, whereby traffic can pass from the first pathway exit path, over the first minor bridge crossover and to the third pathway entrance path; and the second exit-entrance communication lane constructed and arranged to pass over the second minor bridge crossover and communicate between the second pathway exit path and the fourth pathway entrance path, whereby traffic can pass from the second pathway exit path, over the second minor bridge crossover and to the fourth pathway entrance path.

2. The crossover for travel paths of claim 1, wherein the first side is the right side and the second side is the left side.

3. The crossover for travel paths of claim 1, wherein the third pathway is configured to provide through passage for a vehicle without requiring the vehicle to change lanes.

4. The crossover for travel paths of claim 1, wherein the third pathway is configured to provide through passage for a vehicle without requiring the vehicle to change lanes and the fourth pathway is configured to provide through passage for a vehicle without requiring the vehicle to change lanes.

5. A crossover for travel paths comprising:

an interchange region defined by an interchange boundary and having a major crossover subregion centrally disposed therein;

a primary travel path extending through the interchange region and through the major crossover subregion, the primary travel path having a first pathway arranged for travel in a first direction and a second pathway arranged for travel in a second direction, the first and second pathways arranged so as to not cross over one another throughout the interchange region;

a secondary travel path extending through the interchange region and passing sequentially through a first minor crossover subregion, the major crossover subregion and a second minor crossover subregion, each minor crossover subregion contained within the interchange region, the secondary travel path having a third pathway arranged for travel in a third direction and a fourth pathway arranged for travel in a fourth direction;

a main bridge crossover positioned in the main crossover subregion and constructed and arranged so that each of the first and second pathways cross under each of the third and fourth pathways without intersecting at grade and further configured so that the third and fourth pathways are oppositely sloped as they pass through the main crossover region;

a first minor bridge crossover positioned in the first minor crossover subregion, the crossover constructed and arranged so that the third and fourth pathways are each provided with opposing grade change approach zones and configured so that the third pathway crosses over the fourth pathway without intersecting at grade;

the opposing grade change approach zones each positioned proximal to the first minor bridge crossover and each providing an elevation change sufficient to accommodate the crossover, whereby the pathway passing underneath the other pathway descends as it approaches the first minor bridge crossover, and whereby the pathway passing over the other pathway ascends as it approaches the first minor bridge crossover;

the first minor bridge crossover further configured to receive a first exit-entrance communication lane;

a second minor bridge crossover positioned in the second minor crossover subregion, the crossover constructed and arranged so that the third and fourth pathways are each provided with opposing grade change approach zones and configured so that the fourth pathway crosses over the third pathway without intersecting at grade;

the opposing grade change approach zones each positioned proximal to the second minor bridge crossover and each providing an elevation change sufficient to accommodate the crossover, whereby the pathway passing underneath the other pathway descends as it approaches the second minor bridge crossover, and whereby the pathway passing over the other pathway ascends as it approaches the second minor bridge crossover;

the second minor bridge crossover further configured to receive a second exit-entrance communication lane;

each pathway having at least one lane, a first side and a second side and passing through the interchange boundary twice, thereby defining sequentially for each pathway a first pathway terminus and a second pathway terminus;

the first pathway having an exit path provided on the first side and positioned proximate to the first pathway first terminus;

the first pathway having an entrance path provided on the first side and positioned proximate to the first pathway second terminus;

the second pathway having an exit path provided on the first side and positioned proximate to the second pathway first terminus;

the second pathway having an entrance path provided on the first side and positioned proximate to the second pathway second terminus;

the third pathway having a first exit path provided on the first side and positioned proximate to the third pathway first terminus;

the third pathway having a first entrance path provided on the first side and positioned between the first minor crossover subregion and the major crossover subregion;

the third pathway having a second exit path provided on the second side and positioned between the major crossover subregion and the second minor crossover subregion;

the third pathway having a second entrance path provided on the first side and positioned proximate to the third pathway second termmus;

the fourth pathway having a first exit path provided on the first side and positioned proximate to the fourth pathway first terminus;

the fourth pathway haying a first entrance path provided on the first side and positioned between the second minor crossover subregion and the major crossover subregion;

the fourth pathway having a second exit path provided on the second side and positioned between the major crossover subregion and the first minor crossover subregion;

the fourth pathway having a second entrance path provided on the first side and positioned proximate to the fourth pathway second terminus;

the first pathway exit path providing communication with the third pathway first entrance path;

the first pathway exit path providing communication with the fourth pathway second entrance path;

the second pathway exit path providing communication with the fourth pathway first entrance path;

the second pathway exit path providing communication with the third pathway second entrance path;

the third pathway first exit path providing communication with the first pathway entrance path;

the third pathway second exit path providing communication with the second pathway entrance path;

the fourth pathway first exit path providing communication with the second pathway entrance path; and the fourth pathway second exit path providing communication with the first pathway entrance path;

the first exit-entrance communication lane constructed and arranged to pass over the first minor bridge crossover and communicate between the first pathway exit path and the third pathway entrance path, whereby traffic can pass from the first pathway exit path, over the first minor bridge crossover and to the third pathway entrance path; and the second exit-entrance communication lane constructed and arranged to pass over the second minor bridge crossover and communicate between the second pathway exit path and the fourth pathway entrance path, whereby traffic can pass from the second pathway exit path, over the second minor bridge crossover and to the fourth pathway entrance path.

6. The crossover for travel paths of claim 5, wherein the third pathway is configured to provide through passage for a vehicle without requiring the vehicle to change lanes.

7. The crossover for travel paths of claim 5, wherein the third pathway is configured to provide through passage for a vehicle without requiring, the vehicle to change lanes and the fourth pathway is configured to provide through passage for a vehicle without requiring the vehicle to change lanes.

8. The crossover for travel paths of claim 5, wherein the first side is the right side and the second side is the left side.

9. A crossover for travel paths comprising:

an interchange region defined by an interchange boundary and having a major crossover subregion centrally disposed therein;

a primary travel path extending through the interchange region and through the major crossover subregion, the primary travel path having a first pathway arranged for travel in a first direction and a second pathway arranged for travel in a second direction, the first and second pathways arranged so as to not cross over one another throughout the interchange region, the first and second pathways further having oppositely banked path surfaces throughout the major crossover subregion;

a secondary travel path extending through the interchange region and passing sequentially through a first minor crossover subregion, the major crossover subregion and a second minor crossover subregion, each minor crossover subregion contained within the interchange region, the secondary travel path having a third pathway arranged for travel in a third direction and a fourth pathway arranged for travel in a fourth direction;

a main bridge crossover positioned in the main crossover subregion and constructed and arranged so that each of the first and second pathways cross under each of the third and fourth pathways without intersecting at grade, and further conjured so that the third and fourth pathways are oppositely sloped as they pass through the main crossover subregion;

a first minor bridge crossover positioned in the first minor crossover subregion, the crossover constructed and arranged so that the third and fourth pathways are each provided with opposing grade change approach zones and configured so that the third pathway crosses over the fourth pathway without intersecting at grade;

the opposing grade change approach zones each positioned proximal to the first minor bridge crossover and each providing an elevation change sufficient to accommodate the crossover, whereby the pathway passing underneath the other pathway descends as it approaches the first minor bridge crossover, and whereby the pathway passing over the other pathway ascends as it approaches the first minor bridge crossover;

the first minor bridge crossover further configured to receive a first exit-entrance communication lane;

a second minor bridge crossover positioned in the second minor crossover subregion, the crossover constructed and arranged so that the third and fourth pathways are each provided with opposing grade change approach zones and configured so that the fourth pathway crosses over the third pathway without intersecting at grade;

the opposing grade change approach zones each positioned proximal to the second minor bridge crossover and each providing an elevation change sufficient to accommodate the crossover, whereby the pathway passing underneath the other pathway descends as it approaches the second minor bridge crossover, and whereby the pathway passing over the other pathway ascends as it approaches the second minor bridge crossover;

the second minor bridge crossover further configured to receive a second exit-entrance communication lane;

each pathway having at least one lane, a right side and a left side and passing through the interchange boundary twice, thereby defining sequentially for each pathway a first pathway terminus and a second pathway terminus;

the first pathway having an exit path provided on the right side and positioned proximate to the first pathway first terminus;

the first pathway having an entrance path provided on the right, side and positioned proximate to the first pathway second terminus;

the second pathway having an exit path provided on the right side and positioned proximate to the second pathway first terminus;

the second pathway having an entrance path provided on the right side and positioned proximate to the second pathway second terminus;

the third pathway having a first exit path provided on the right side and positioned proximate to the third pathway first terminus;

the third pathway having a first entrance path provided on the right side and positioned between the first minor crossover subregion and the major crossover subregion;

the third pathway having a second exit path provided on the left side and positioned between the major crossover subregion and the second minor crossover subregion;

the third pathway having a second entrance path provided on the right side and positioned proximate to the third pathway second terminus;

the fourth pathway having a first exit path provided on the right side and positioned proximate to the fourth pathway first terminus;

the fourth pathway having a first entrance path provided on the right side and positioned between the second minor crossover subregion and the major crossover subregion the fourth pathway having a second exit path provided on the left side and positioned between the major crossover subregion and the first minor crossover subregion;

the fourth pathway having a second entrance path provided the right side and positioned proximate to the fourth pathway second terminus;

the first pathway exit path providing communication with the third pathway first entrance path;

the first pathway exit path providing communication with the fourth pathway second entrance path;

the second pathway exit path providing communication with the fourth pathway first entrance path;

the second pathway exit path providing communication with the third pathway second entrance path;

the third pathway first exit path providing communication with the first pathway entrance path;

the third pathway second exit path providing communication with the second pathway entrance path;

the fourth pathway first exit path providing communication with the second pathway entrance path; and the fourth pathway second exit path providing communication with the first pathway entrance path;

the first exit-entrance communication lane constructed and arranged to pass over the first minor bridge crossover and communicate between the first pathway exit path and the third pathway entrance path, whereby traffic can pass from the first pathway exit path, over the first minor bridge crossover and to the third pathway entrance path; and the second exit-entrance communication lane constructed and arranged to pass over the second minor bridge crossover and communicate between the second pathway exit path and the fourth pathway entrance path, whereby traffic can pass from the second pathway exit path, over the second minor bridge crossover and to the fourth pathway entrance path.

* * * * *